US006882351B2

(12) United States Patent
Morita

(10) Patent No.: US 6,882,351 B2
(45) Date of Patent: Apr. 19, 2005

(54) DISPLAY APPARATUS WITH IMPROVED SUPPRESSION OF PSEUDO-CONTOURS

(75) Inventor: Takehiko Morita, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 309 days.

(21) Appl. No.: 10/183,456

(22) Filed: Jun. 28, 2002

(65) Prior Publication Data

US 2003/0001871 A1 Jan. 2, 2003

(30) Foreign Application Priority Data

Jun. 28, 2001 (JP) ..... 2001-196150

(51) Int. Cl.[7] ..... G09G 3/28

(52) U.S. Cl. ..... 345/690; 345/63; 345/77; 345/596

(58) Field of Search ..... 345/690, 691–692, 345/204, 596–597, 474, 60, 63, 77, 66–69, 88–89, 208–210; 315/169.1, 169.3, 169.4

(56) References Cited

U.S. PATENT DOCUMENTS 6,091,396 A * 7/2000 Minami et al. ..... 345/690
6,100,939 A * 8/2000 Kougami et al. ..... 348/687
6,529,204 B1 * 3/2003 Mikoshiba et al. ..... 345/597
6,693,609 B1 * 2/2004 Lee et al. ..... 345/63

FOREIGN PATENT DOCUMENTS

| | | |
|---|---|---|
| JP | 6301353 | 10/1994 |
| JP | 06-301353 | * 10/1994 |
| JP | 09-230822 | * 5/1997 |
| JP | 9-230822 | 9/1997 |
| JP | 2900968 | * 3/1999 |
| JP | 2002-006794 | 1/2002 |
| JP | 2002-006794 | * 11/2002 |

* cited by examiner

*Primary Examiner*—Lun-yi Lao
(74) *Attorney, Agent, or Firm*—Birch, Stewart, Kolasch & Birch, LLP

(57) ABSTRACT

A display apparatus using a subfield drive system suppresses pseudo-contours in moving pictures by identifying areas with smoothly varying gradation values, determining the minimum and maximum gradation values in each such area, and processing the area so that all gradations in the range from the minimum gradation value to the maximum gradation value can be displayed without altering the states of any subfields having durations longer than a predetermined duration. This is accomplished by selecting a subfield sequence free of such state alterations and using the selected subfield sequence to display the area, or by modifying the gradation values in the area so as to avoid gradations at which such state alterations occur.

21 Claims, 20 Drawing Sheets

FIG.3A

| | SF8 | SF7 | SF6 | SF5 | SF4 | SF3 | SF2 | SF1 | SF0 |
|---|---|---|---|---|---|---|---|---|---|
| G \ L | 80 | 64 | 48 | 32 | 16 | 8 | 4 | 2 | 1 |
| 0 | 0 | 0 | 0 | 0 | 0 | 0 | 0 | 0 | 0 |
| 1~14 | 0 | 0 | 0 | 0 | 0 | | | | |
| 15 | 0 | 0 | 0 | 0 | 0 | 1 | 1 | 1 | 1 |
| 16 | 0 | 0 | 0 | 0 | 1 | 0 | 0 | 0 | 0 |
| 17~30 | 0 | 0 | 0 | 0 | 1 | | | | |
| 31 | 0 | 0 | 0 | 0 | 1 | 1 | 1 | 1 | 1 |
| 32 | 0 | 0 | 0 | 1 | 0 | 0 | 0 | 0 | 0 |
| 33~46 | 0 | 0 | 0 | 1 | 0 | | | | |
| 47 | 0 | 0 | 0 | 1 | 0 | 1 | 1 | 1 | 1 |
| 48 | 0 | 0 | 0 | 1 | 1 | 0 | 0 | 0 | 0 |
| 49~62 | 0 | 0 | 0 | 1 | 1 | | | | |
| (CA1) 63 | 0 | 0 | 0 | 1 | 1 | 1 | 1 | 1 | 1 |
| 64 | 0 | 0 | 1 | 0 | 1 | 0 | 0 | 0 | 0 |
| 65~78 | 0 | 0 | 1 | 0 | 1 | | | | |
| 79 | 0 | 0 | 1 | 0 | 1 | 1 | 1 | 1 | 1 |
| 80 | 0 | 0 | 1 | 1 | 0 | 0 | 0 | 0 | 0 |
| 81~94 | 0 | 0 | 1 | 1 | 0 | | | | |
| (CA2) 95 | 0 | 0 | 1 | 1 | 0 | 1 | 1 | 1 | 1 |
| 96 | 0 | 1 | 0 | 1 | 0 | 0 | 0 | 0 | 0 |
| 97~110 | 0 | 1 | 0 | 1 | 0 | | | | |
| 111 | 0 | 1 | 0 | 1 | 0 | 1 | 1 | 1 | 1 |
| 112 | 00 | 1 | 0 | 1 | 1 | 0 | 0 | 0 | 0 |
| 113~126 | 0 | 1 | 0 | 1 | 1 | | | | |
| (CA3) 127 | 0 | 1 | 0 | 1 | 1 | 1 | 1 | 1 | 1 |
| 128 | 0 | 1 | 1 | 0 | 1 | 0 | 0 | 0 | 0 |
| 129~142 | 0 | 1 | 1 | 0 | 1 | | | | |
| 143 | 0 | 1 | 1 | 0 | 1 | 1 | 1 | 1 | 1 |
| 144 | 0 | 1 | 1 | 1 | 0 | 0 | 0 | 0 | 0 |
| 145~158 | 0 | 1 | 1 | 1 | 0 | | | | |
| (CA4) 159 | 0 | 1 | 1 | 1 | 0 | 1 | 1 | 1 | 1 |
| 160 | 1 | 0 | 1 | 1 | 0 | 0 | 0 | 0 | 0 |
| 161~174 | 1 | 0 | 1 | 1 | 0 | | | | |
| 175 | 1 | 0 | 1 | 1 | 0 | 1 | 1 | 1 | 1 |
| 176 | 1 | 0 | 1 | 1 | 1 | 0 | 0 | 0 | 0 |
| 177~190 | 1 | 0 | 1 | 1 | 1 | | | | |
| (CA5) 191 | 1 | 0 | 1 | 1 | 1 | 1 | 1 | 1 | 1 |
| 192 | 1 | 1 | 1 | 0 | 0 | 0 | 0 | 0 | 0 |
| 193~206 | 1 | 1 | 1 | 0 | 0 | | | | |
| 207 | 1 | 1 | 1 | 0 | 0 | 1 | 1 | 1 | 1 |
| 208 | 1 | 1 | 1 | 0 | 1 | 0 | 0 | 0 | 0 |
| 209~222 | 1 | 1 | 1 | 0 | 1 | | | | |
| 223 | 1 | 1 | 1 | 0 | 1 | 1 | 1 | 1 | 1 |
| 224 | 1 | 1 | 1 | 1 | 0 | 0 | 0 | 0 | 0 |
| 225~238 | 1 | 1 | 1 | 1 | 0 | | | | |
| 239 | 1 | 1 | 1 | 1 | 0 | 1 | 1 | 1 | 1 |
| 240 | 1 | 1 | 1 | 1 | 1 | 0 | 0 | 0 | 0 |
| 241~254 | 1 | 1 | 1 | 1 | 1 | | | | |
| 255 | 1 | 1 | 1 | 1 | 1 | 1 | 1 | 1 | 1 |

FIG.3B

| | SF8 | SF7 | SF6 | SF5 | SF4 | SF3 | SF2 | SF1 | SF0 |
|---|---|---|---|---|---|---|---|---|---|
| G \ L | 80 | 64 | 48 | 32 | 16 | 8 | 4 | 2 | 1 |
| 0 | 0 | 0 | 0 | 0 | 0 | 0 | 0 | 0 | 0 |
| 1~14 | 0 | 0 | 0 | 0 | 0 | | | | |
| 15 | 0 | 0 | 0 | 0 | 0 | 1 | 1 | 1 | 1 |
| 16 | 0 | 0 | 0 | 0 | 1 | 0 | 0 | 0 | 0 |
| 17~30 | 0 | 0 | 0 | 0 | 1 | | | | |
| 31 | 0 | 0 | 0 | 0 | 1 | 1 | 1 | 1 | 1 |
| 32 | 0 | 0 | 0 | 1 | 0 | 0 | 0 | 0 | 0 |
| 33~46 | 0 | 0 | 0 | 1 | 0 | | | | |
| (CB1) 47 | 0 | 0 | 0 | 1 | 0 | 1 | 1 | 1 | 1 |
| 48 | 0 | 0 | 1 | 0 | 0 | 0 | 0 | 0 | 0 |
| 49~62 | 0 | 0 | 1 | 0 | 0 | | | | |
| 63 | 0 | 0 | 1 | 0 | 0 | 1 | 1 | 1 | 1 |
| 64 | 0 | 0 | 1 | 0 | 1 | 0 | 0 | 0 | 0 |
| 65~78 | 0 | 0 | 1 | 0 | 1 | | | | |
| (CB2) 79 | 0 | 0 | 1 | 0 | 1 | 1 | 1 | 1 | 1 |
| 80 | 0 | 1 | 0 | 0 | 1 | 0 | 0 | 0 | 0 |
| 81~94 | 0 | 1 | 0 | 0 | 1 | | | | |
| 95 | 0 | 1 | 0 | 0 | 1 | 1 | 1 | 1 | 1 |
| 96 | 0 | 1 | 0 | 1 | 0 | 0 | 0 | 0 | 0 |
| 97~110 | 0 | 1 | 0 | 1 | 0 | | | | |
| (CB3) 111 | 0 | 1 | 0 | 1 | 0 | 1 | 1 | 1 | 1 |
| 112 | 0 | 1 | 1 | 0 | 0 | 0 | 0 | 0 | 0 |
| 113~126 | 0 | 1 | 1 | 0 | 0 | | | | |
| 127 | 0 | 1 | 1 | 0 | 0 | 1 | 1 | 1 | 1 |
| 128 | 0 | 1 | 1 | 0 | 1 | 0 | 0 | 0 | 0 |
| 129~142 | 0 | 1 | 1 | 0 | 1 | | | | |
| (CB4) 143 | 0 | 1 | 1 | 0 | 1 | 1 | 1 | 1 | 1 |
| 144 | 1 | 0 | 1 | 0 | 1 | 0 | 0 | 0 | 0 |
| 145~158 | 1 | 0 | 1 | 0 | 1 | | | | |
| 159 | 1 | 0 | 1 | 0 | 1 | 1 | 1 | 1 | 1 |
| 160 | 1 | 0 | 1 | 1 | 0 | 0 | 0 | 0 | 0 |
| 161~174 | 1 | 0 | 1 | 1 | 0 | | | | |
| (CB5) 175 | 1 | 0 | 1 | 1 | 0 | 1 | 1 | 1 | 1 |
| 176 | 1 | 1 | 0 | 1 | 0 | 0 | 0 | 0 | 0 |
| 177~190 | 1 | 1 | 0 | 1 | 0 | | | | |
| 191 | 1 | 1 | 0 | 1 | 0 | 1 | 1 | 1 | 1 |
| 192 | 1 | 1 | 0 | 1 | 1 | 0 | 0 | 0 | 0 |
| 193~206 | 1 | 1 | 0 | 1 | 1 | | | | |
| (CB6) 207 | 1 | 1 | 0 | 1 | 1 | 1 | 1 | 1 | 1 |
| 208 | 1 | 1 | 1 | 0 | 1 | 0 | 0 | 0 | 0 |
| 209~222 | 1 | 1 | 1 | 0 | 1 | | | | |
| 223 | 1 | 1 | 1 | 0 | 1 | 1 | 1 | 1 | 1 |
| 224 | 1 | 1 | 1 | 1 | 0 | 0 | 0 | 0 | 0 |
| 225~238 | 1 | 1 | 1 | 1 | 0 | | | | |
| 239 | 1 | 1 | 1 | 1 | 0 | 1 | 1 | 1 | 1 |
| 240 | 1 | 1 | 1 | 1 | 1 | 0 | 0 | 0 | 0 |
| 241~254 | 1 | 1 | 1 | 1 | 1 | | | | |
| 255 | 1 | 1 | 1 | 1 | 1 | 1 | 1 | 1 | 1 |

FIG.4A

| | | | | | | | | | | | | | | | | |
|---|---|---|---|---|---|---|---|---|---|---|---|---|---|---|---|---|
| 175 | 174 | 173 | 172 | 171 | 170 | 169 | 168 | 167 | 166 | 165 | 164 | 163 | 162 | 161 | 160 | 159 |
| 174 | 173 | 172 | 171 | 170 | 169 | 168 | 167 | 166 | 165 | 164 | 163 | 162 | 161 | 160 | 159 | 158 |
| 173 | 172 | 171 | 170 | 169 | 168 | 167 | 166 | 165 | 164 | 163 | 162 | 161 | 160 | 159 | 158 | 157 |
| 172 | 171 | 170 | 169 | 168 | 167 | 166 | 165 | 164 | 163 | 162 | 161 | 160 | 159 | 158 | 157 | 156 |
| 171 | 170 | 169 | 168 | 167 | 166 | 165 | 164 | 163 | 162 | 161 | 160 | 159 | 158 | 157 | 156 | 155 |
| 170 | 169 | 168 | 167 | 166 | 165 | 164 | 163 | 162 | 161 | 160 | 159 | 158 | 157 | 156 | 155 | 154 |
| 169 | 168 | 167 | 166 | 165 | 164 | 163 | 162 | 161 | 160 | 159 | 158 | 157 | 156 | 155 | 154 | 153 |
| 168 | 167 | 166 | 165 | 164 | 163 | 162 | 161 | 160 | 159 | 158 | 157 | 156 | 155 | 154 | 153 | 152 |
| 167 | 166 | 165 | 164 | 163 | 162 | 161 | 160 | 159 | 158 | 157 | 156 | 155 | 154 | 153 | 152 | 151 |
| 166 | 165 | 164 | 163 | 162 | 161 | 160 | 159 | 158 | 157 | 156 | 155 | 154 | 153 | 152 | 151 | 150 |
| 165 | 164 | 163 | 162 | 161 | 160 | 159 | 158 | 157 | 156 | 155 | 154 | 153 | 152 | 151 | 150 | 149 |
| 164 | 163 | 162 | 161 | 160 | 159 | 158 | 157 | 156 | 155 | 154 | 153 | 152 | 151 | 150 | 149 | 148 |
| 163 | 162 | 161 | 160 | 159 | 158 | 157 | 156 | 155 | 154 | 153 | 152 | 151 | 150 | 149 | 148 | 147 |
| 162 | 161 | 160 | 159 | 158 | 157 | 156 | 155 | 154 | 153 | 152 | 151 | 150 | 149 | 148 | 147 | 146 |
| 161 | 160 | 159 | 158 | 157 | 156 | 155 | 154 | 153 | 152 | 151 | 150 | 149 | 148 | 147 | 146 | 145 |
| 160 | 159 | 158 | 157 | 156 | 155 | 154 | 153 | 152 | 151 | 150 | 149 | 148 | 147 | 146 | 145 | 144 |

FIG.4B

| | | | | | | | | | | | | | | | | |
|---|---|---|---|---|---|---|---|---|---|---|---|---|---|---|---|---|
| 180 | 179 | 178 | 177 | 176 | 175 | 174 | 173 | 172 | 171 | 170 | 169 | 168 | 167 | 166 | 165 | 164 |
| 179 | 178 | 177 | 176 | 175 | 174 | 173 | 172 | 171 | 170 | 169 | 168 | 167 | 166 | 165 | 164 | 163 |
| 178 | 177 | 176 | 175 | 174 | 173 | 172 | 171 | 170 | 169 | 168 | 167 | 166 | 165 | 164 | 163 | 162 |
| 177 | 176 | 175 | 174 | 173 | 172 | 171 | 170 | 169 | 168 | 167 | 166 | 165 | 164 | 163 | 162 | 161 |
| 176 | 175 | 174 | 173 | 172 | 171 | 170 | 169 | 168 | 167 | 166 | 165 | 164 | 163 | 162 | 161 | 160 |
| 175 | 174 | 173 | 172 | 171 | 170 | 169 | 168 | 167 | 166 | 165 | 164 | 163 | 162 | 161 | 160 | 159 |
| 174 | 173 | 172 | 171 | 170 | 169 | 168 | 167 | 166 | 165 | 164 | 163 | 162 | 161 | 160 | 159 | 158 |
| 173 | 172 | 171 | 170 | 169 | 168 | 167 | 166 | 165 | 164 | 163 | 162 | 161 | 160 | 159 | 158 | 157 |
| 172 | 171 | 170 | 169 | 168 | 167 | 166 | 165 | 164 | 163 | 162 | 161 | 160 | 159 | 158 | 157 | 156 |
| 171 | 170 | 169 | 168 | 167 | 166 | 165 | 164 | 163 | 162 | 161 | 160 | 159 | 158 | 157 | 156 | 155 |
| 170 | 169 | 168 | 167 | 166 | 165 | 164 | 163 | 162 | 161 | 160 | 159 | 158 | 157 | 156 | 155 | 154 |
| 169 | 168 | 167 | 166 | 165 | 164 | 163 | 162 | 161 | 160 | 159 | 158 | 157 | 156 | 155 | 154 | 153 |
| 168 | 167 | 166 | 165 | 164 | 163 | 162 | 161 | 160 | 159 | 158 | 157 | 156 | 155 | 154 | 153 | 152 |
| 167 | 166 | 165 | 164 | 163 | 162 | 161 | 160 | 159 | 158 | 157 | 156 | 155 | 154 | 153 | 152 | 151 |
| 166 | 165 | 164 | 163 | 162 | 161 | 160 | 159 | 158 | 157 | 156 | 155 | 154 | 153 | 152 | 151 | 150 |
| 165 | 164 | 163 | 162 | 161 | 160 | 159 | 158 | 157 | 156 | 155 | 154 | 153 | 152 | 151 | 150 | 149 |

DISPLAY APPARATUS WITH IMPROVED SUPPRESSION OF PSEUDO-CONTOURS

BACKGROUND OF THE INVENTION

1. Field of the Invention

The present invention relates to a display apparatus, employing a subfield drive system, and more particularly to the suppression of pseudo-contours in such a display apparatus.

2. Description of the Related Art

The subfield drive system is used in, for example, display apparatus having a plasma display panel (PDP). PDP displays are currently employed in large-screen, flat-panel television sets. Conventional PDP display apparatus of this type, as disclosed in Japanese Unexamined Patent Application Publication No. 10-116053, is described below.

FIG. 13 shows a conventional PDP display apparatus 100 having a pair of input terminals 1, 2 that receive an analog picture signal and a synchronizing signal, respectively. An analog-to-digital converter (ADC) 3 digitizes the picture signal. A code converter 11 converts the digital picture signal to a coded signal representing subfield patterns. A field memory 14 stores the subfield patterns for two fields. A driver 15 reads the subfield patterns from the field memory 14 and drives a PDP 16. A controller 18 controls the analog-to-digital converter 3, field memory 14, and driver 15 according to the synchronizing signal.

The input analog picture signal is, for example, a video signal comprising a series of frames, each made up of an interlaced pair of fields. The analog-to-digital converter 3 converts the analog gradation value of each picture element (pixel) to an eight-bit code in which the eight bits (b7, b6, b5, b4, b3, b2, b1, b0, in order from the most significant bit) are weighted according to powers of two (128, 64, 32, 16, 8, 4, 2, 1). This enables two hundred fifty-six gradations (0 to 255) to be expressed.

If the eight-bit digital picture signal were to be stored directly in the field memory 14, without code conversion, the driver 15 and PDP 16 would operate as illustrated in FIG. 14. FIG. 14 shows a single field display interval divided into eight subfields (SF0 to SF7). Each subfield includes an addressing interval (X) and a sustaining discharge interval (hatched). The addressing intervals all have the same length, but the lengths of the sustaining discharge intervals vary in proportion to the bit weights of bits b0 to b7. During the addressing interval of subfield interval SF0, the driver 15 reads the b0 data for all pixels in the field (the b0 bit plane of the field) from the field memory 14, and writes the b0 data into the PDP 16. The PDP 16 is of the alternating-current (AC) type and has a memory feature, retaining the b0 data for each pixel until the entire b0 bit plane has been written. During the ensuing sustaining discharge interval (not visible for subfield SF0 in FIG. 14) the pixels with '1' data emit light. The other bits (b1 to b7) are processed in the same way, the length of the sustaining discharge interval doubling at each bit plane. The total amount of light emitted by each pixel in the PDP 16 is thus proportional to the luminance gradation expressed by the eight-bit data. The human visual system integrates the emitted light so that a picture with the intended gradation levels is perceived.

If the picture is a moving picture with smoothly varying gradations, however, the viewer may also perceive unintended colored bands, or bands that are lighter or darker than their neighbors. These bands, referred to as pseudo-contours, are a major factor degrading the picture quality of a moving picture displayed on a PDP. The reason for their occurrence is explained in FIGS. 15 and 16.

FIG. 15 schematically shows part of one raster line of a picture that is moving to the left on the screen. The horizontal axis indicates pixel position; the vertical axis indicates time. In one field, shown in the upper half of FIG. 15, five consecutive pixels in the raster line have gradation value 127 (represented by bit data '01111111'), and the next few pixels have gradation value 128 (represented by '10000000'). In the following field, shown in the lower part of FIG. 15, this pattern has moved two pixels to the left. As the picture moves, the viewer's eye tends to track the motion, so that light emitted from all points on dotted line $R_0$ impinges on a single point on the viewer's retina. The same is true of lines $R_1$ and $R_2$.

FIG. 16 shows the relationship between retinal position and perceived luminance gradation. Point $R_0$ is perceived with the correct gradation value of 127 and point $R_2$ with the correct gradation value of 128, but point $R_1$ appears to have substantially zero luminance. If the same pattern occurs in other raster lines as well, it is perceived as a vertical pseudo-contour moving to the left.

The cause of the pseudo-contour is that around point $R_1$, the motion of the picture is accompanied by a 'rollover' in which bits b0 to b6 change from '1' to '0' and bit b7 simultaneously changes from '0' to '1'. A similar pseudo-contour would be perceived if the picture were moving toward the right, with bits b0 to b6 changing from '0' to '1' and bit b7 from '1' to '0'. Strictly speaking, a rollover is said to occur whenever an increment or decrement of one gradation level produces a carry or borrow at any bit position, so that one bit changes from '0' to '1' and another bit changes from '1' to '0'. Pseudo-contours are most noticeable when there is a rollover involving the most significant bit (b7).

If analyzed further, the pseudo-contour phenomenon is found to occur when a gradation change is accompanied by a large shift in the temporal center of gravity of light emission and a large shift in the sustaining discharge intervals during which light is emitted. In FIG. 15, for example, for gradation 127, light emission is concentrated in the first half of the field interval, while for gradation 128, light emission is concentrated in the second half; when the gradation value changes from 127 to 128, all sustaining discharge intervals in the first half of the field interval change from emitting light to not emitting light, and all sustaining discharge intervals in the second half of the field interval (the single sustaining discharge interval of subfield SF7) change from not emitting light to emitting light.

To mitigate the deterioration of moving-picture quality due to pseudo-contours, the code converter 11 in FIG. 13 converts the eight-bit digital code (b0 to b7) output from the analog-to-digital converter 3 to a nine-bit digital code (bb0, bb1, bb2, bb3, bb4, bb5, bb6, bb7, bb8), and the driver 15 divides the field interval into nine subfields (SF0 to SF8) as illustrated in FIG. 17. Each subfield again comprises an addressing interval (X) and a sustaining discharge interval (hatched). The display operation is performed in the manner described above; in each nine-bit code, a '1' causes light to be emitted during the sustaining discharge interval of the corresponding subfield. The lengths of the sustaining discharge intervals are not all proportional to powers of two, however. For example, the ratios of the lengths may be 1:2:4:8:16:32:48:64:80, in order from SF0 to SF8. These values still sum to two hundred fifty-five (1+2+4+8+16+32+

48+64+80=255), so two hundred fifty-six gradations from 0 to 255 are displayable by appropriate combinations of light-emitting subfields and non-light-emitting subfields.

With a code in which the bits are weighted according to powers of two, a given graduation is representable by only one pattern of subfields. For example, the only subfield pattern representing gradation 64 is (b7, b6, b5, b4, b3, b2, b1, b0)=(0, 1, 0, 0, 0, 0, 0, 0), and the only subfield pattern representing gradation 128 is (b7, b6, b5, b4, b3, b2, b1, b0)=(1, 0, 0, 0, 0, 0, 0, 0).

With nine-bit codes and bit weights of 80, 64, 48, 32, 16, 8, 4, 2, 1, however, some gradations are representable by a plurality of subfield patterns. For example, there are two (bb8, bb7, bb6, bb5, bb4, bb3, bb2, bb1, bb0) patterns corresponding to gradation 64, namely (0, 0, 1, 0, 1, 0, 0, 0, 0) and (0, 1, 0, 0, 0, 0, 0, 0, 0), and three patterns corresponding to gradation 128, namely (0, 1, 1, 0, 1, 0, 0, 0, 0), (1, 0, 1, 0, 0, 0, 0, 0, 0), and (1, 0, 0, 1, 1, 0, 0, 0, 0). The code converter 11 may operate according to a rule that always assigns the same nine-bit code and thus the same subfield pattern to each gradation value. A sequential arrangement of the subfield patterns assigned to each gradation level from zero to the maximum gradation (in this case, 255) will be referred below to as a 'subfield sequence' or simply as a 'sequence'.

FIG. 18 illustrates one sequence by showing the values of bits bb3 to bb8, which are weighted in the ratios of 8:16:32:48:64:80. (The values of bits bb0, bb1, and bb2 are the same as the values of bits b0, b1, and b2 in an eight-bit code.) The column widths in FIG. 18 are proportional to the bit weights. This sequence always assigns '1' values, indicated by hatching, to bits having the smallest possible weights. The sequence has the following property: if there is a gradation n ($0 \leqq n \leqq 254$) in which a bit bbx (e.g., bb7) is '1' and the next higher bit bby (e.g., bb8) is '0', and if bit bby is '1' in the next higher gradation (n+1), then bit bbx is '0' in this next higher gradation (n+1). This property will be referred to below as the 'rollover rule'. In FIG. 18 the rollover rule is obeyed in all bit positions.

FIG. 19 illustrates a moving picture having a rollover at the most significant bit position in the sequence in FIG. 18. The horizontal axis of FIG. 19 again represents pixel position in one raster line on the screen, and the vertical axis represents time. The rollover occurs when the gradation value changes from 175 to 176. The point at which this change occurs is again moving to the left at a rate of two pixels per frame. The viewer's eye follows the motion, so all light emitted at points on dotted lint $R_0$, for example, impinges on the same point on the viewer's retina, and the same is true of lines $R_1$ to $R_4$. FIG. 20 plots perceived luminance as a function of retinal position. The dip at point $R_3$, corresponding to the rollover from subfield SF7 to subfield SF8, is mitigated by the light that continues to be emitted in subfields SF5 and SF6, making the pseudo-contour less noticeable than in FIG. 15. The reason is that the temporal center of gravity of the light emission does not shift as much as in FIG. 15, and there is less total change between the light-emitting and non-light-emitting states. In FIG. 19, the total length of the sustaining discharge intervals in subfields changing from the on-state to the off-state is only 79 (1+2+4+8+64), and the length of the sustaining discharge interval in the single subfield changing from the off-state to the on-state is only 80; in FIG. 15, the corresponding lengths were 127 and 128.

A similar mitigating effect can be obtained from other sequences in which the subfields are arranged in order of increasing (or decreasing) length and their length ratios include values that are not powers of two, particularly if these sequences obey the rollover rule.

FIG. 21 shows a conventional display apparatus that takes a further step toward pseudo-contour mitigation. This display apparatus 101 employs a pair of code converters 12*a*, 12*b*, instead of the single code converter 11 in FIG. 13. Both code converters 12*a*, 12*b* receive the digital picture signal output by the analog-to-digital converter 3. A code conversion selector 13 controlled by the controller 20 selects the output of one of the two code converters 12*a*, 12*b*, and supplies the selected output to the field memory 14.

Code converter A 12*a* uses the subfield sequence A shown in FIG. 22A, (the same sequence as in FIG. 19); code converter B 12*b* uses the subfield sequence B shown in FIG. 22B. Both sequences obey the rollover rule.

During operation, the code conversion selector 13 switches between code converter A 12*a* and code converter B 12*b* at intervals corresponding to h pixels in the horizontal direction of the screen ($h \geqq 1$), and v pixels in the vertical direction of the screen ($v \geqq 1$). Aside from this switching of code converters, the display apparatus 101 in FIG. 21 operates in the same way as the display apparatus 100 in FIG. 13.

FIG. 23 shows the same moving picture as in FIG. 19, displayed by subfield sequence B. Once again, the horizontal axis represents pixel position in one raster line on the screen, and the vertical axis represents time. FIG. 24 illustrates perceived luminance as a function of position on the viewer's retina, points $R_0$, and $R_1$, and $R_2$ receiving light emitted from points on the corresponding dotted lines in FIG. 23. In subfield sequence B, the change from gradation 175 to gradation 176 does not alter the value of any of the three most significant bits (corresponding to subfields SF6, SF7, and SF8); the highest-order rollover occurs in the fourth-highest bit (subfield SF5). The dip in perceived luminance at point $R_1$ is consequently much smaller than the dip at point $R_3$ in FIG. 20.

FIG. 25 plots the subfield sequence selection on the PDP screen for a case in which the selection is switched between sequences A and B at relatively narrow pixel intervals, such as intervals of one pixel in the horizontal direction and one pixel in the vertical direction. FIG. 26 shows an example of perceived luminance as a function of retinal position for a transition from gradation 175 to gradation 176 under these conditions. Sequences A and B produce pseudo-contours at two separate locations on the retina, but the perceived luminance function of each pseudo-contour is visually averaged with the perceived luminance function of the other sequence, so both pseudo-contours are reduced to relatively small dips in the perceived luminance curve.

Further reduction of pseudo-contours is possible by switching among three or more subfield sequences at predetermined intervals.

Although the conventional measures described above succeed in mitigating pseudo-contours in moving pictures, they do not eliminate pseudo-contours, because they do not eliminate rollover at high-order bit positions, including the most significant bit position, where the rollover has the most pronounced effect. A basic problem with these methods is that the same processing is applied to all picture areas, even though pseudo-contours are perceived only in picture areas satisfying certain conditions.

SUMMARY OF THE INVENTION

An object of the present invention is to suppress pseudo-contours by eliminating high-order rollover from areas with smoothly varying gradation values.

The invented method of suppressing pseudo-contours extracts an area with smoothly varying gradation values from a predetermined unit, such as one field or one raster line, of a moving-picture signal. The minimum and maximum gradation values in the area are determined. The area is then processed so as to eliminate high-order rollover from the range of gradation values between the minimum gradation value and the maximum gradation value, high-order rollover being defined as a change in the state of any subfield having a light-emission interval longer than a predetermined value.

The invention also provides a display apparatus having a code conversion unit for converting a moving-picture signal to digital codes designating patterns of subfields taken from at least two different subfield sequences, an area detector for detecting areas with smoothly varying gradation values, a gradation range calculator for detecting minimum and maximum gradation values in these areas, a subfield sequence selection unit for selecting a subfield sequence free of high-order rollover in each area, and a signal delay unit for delaying the moving-picture signal input to the code conversion unit by a time equivalent to the total processing time of the area detector, gradation range calculator, and subfield sequence selection unit.

The invention further provides a display apparatus having an area detector for detecting areas with smoothly varying gradation values, a gradation range calculator for detecting minimum and maximum gradation values in these areas, and a gradation modification unit for modifying the gradation values in each area so as to eliminate high-order rollover from the area.

Compared with conventional display apparatus, the invented display apparatus suppresses pseudo-contours more effectively because it actually eliminates high-order rollover from areas with smoothly varying gradation values, instead of merely mitigating the effects of high-order rollover in such areas.

If the areas are detected on a field basis, pseudo-contours moving in all directions are effectively suppressed. If the areas are detected on a raster-line basis, pseudo-contours moving vertically are suppressed somewhat less effectively, but memory requirements are greatly reduced, lowering the cost of the apparatus.

If two different subfield sequences are employed, pseudo-contours are suppressed with a relatively simple circuit structure. If the high-order rollover gradations in the two sequences occur alternately, the probability of being able to eliminate high-order rollover from a given area is maximized. If three or more subfield sequences are employed, this probability is further increased.

When high-order rollover cannot be eliminated from an area, cyclic selection of different subfield sequences provides the same pseudo-contour mitigation effect as in a conventional display apparatus.

If rollover is avoided by modifying the gradation values in an area, pseudo-contours are suppressed by means of relatively simple alterations to existing display apparatus, no new subfield sequences being required. Shifting the range of gradation values in an area up or down requires only addition operations. Compressing the range requires multiplication operations, but yields more natural results.

BRIEF DESCRIPTION OF THE DRAWINGS

FIGS. 3A and 3B show the subfield sequences employed by the code converters in FIG. 1;

FIGS. 4A and 4B show the gradation values of two typical non-edge areas of a picture;

DETAILED DESCRIPTION OF THE INVENTION

Figure 1:
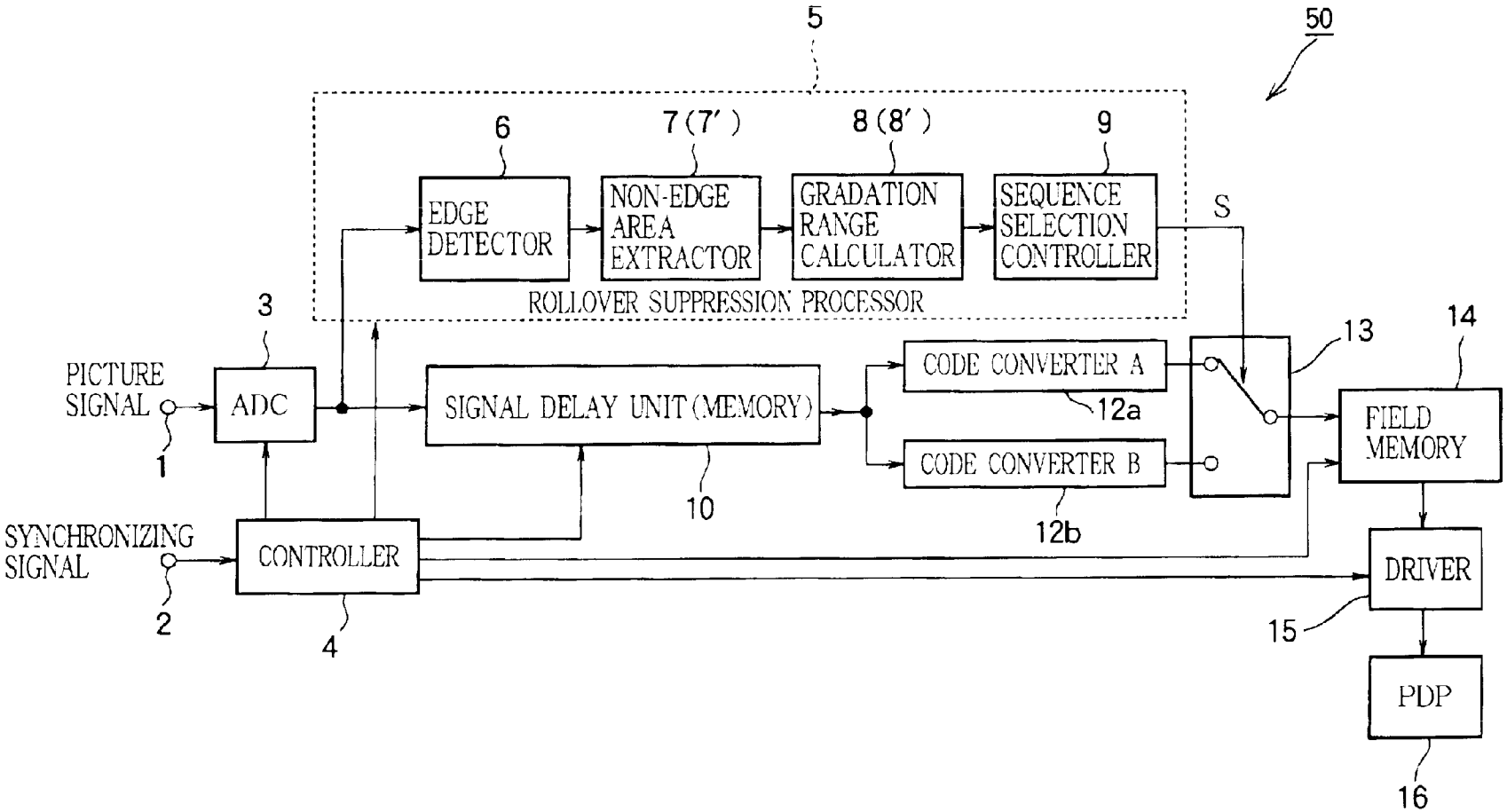
FIG. 1 is a block diagram of a PDP display apparatus illustrating first and third embodiments of the invention.

Embodiments of the invention will now be described with reference to the attached drawings, in which like elements are indicated by like reference characters.

FIG. 1 is a block diagram showing the structure of a display apparatus 50 according to a first embodiment of the invention. Like the conventional display apparatus 100, 101 in FIGS. 13 and 21, this display apparatus 50 has an input terminal 1 that receives an analog picture signal, another input terminal 2 that receives a synchronizing signal, an analog-to-digital converter 3 that converts the analog picture signal to a digital picture signal, and a controller 4 that operates according to the synchronizing signal.

The display apparatus 50 also has a rollover suppression processor 5 comprising an edge detector 6, a non-edge area extractor 7, a gradation range calculator 8, and a sequence selection controller 9. The rollover suppression processor 5 processes the eight-bit digital picture signal output from the analog-to-digital converter 3, and generates a subfield sequence selection signal S.

Figure 21:
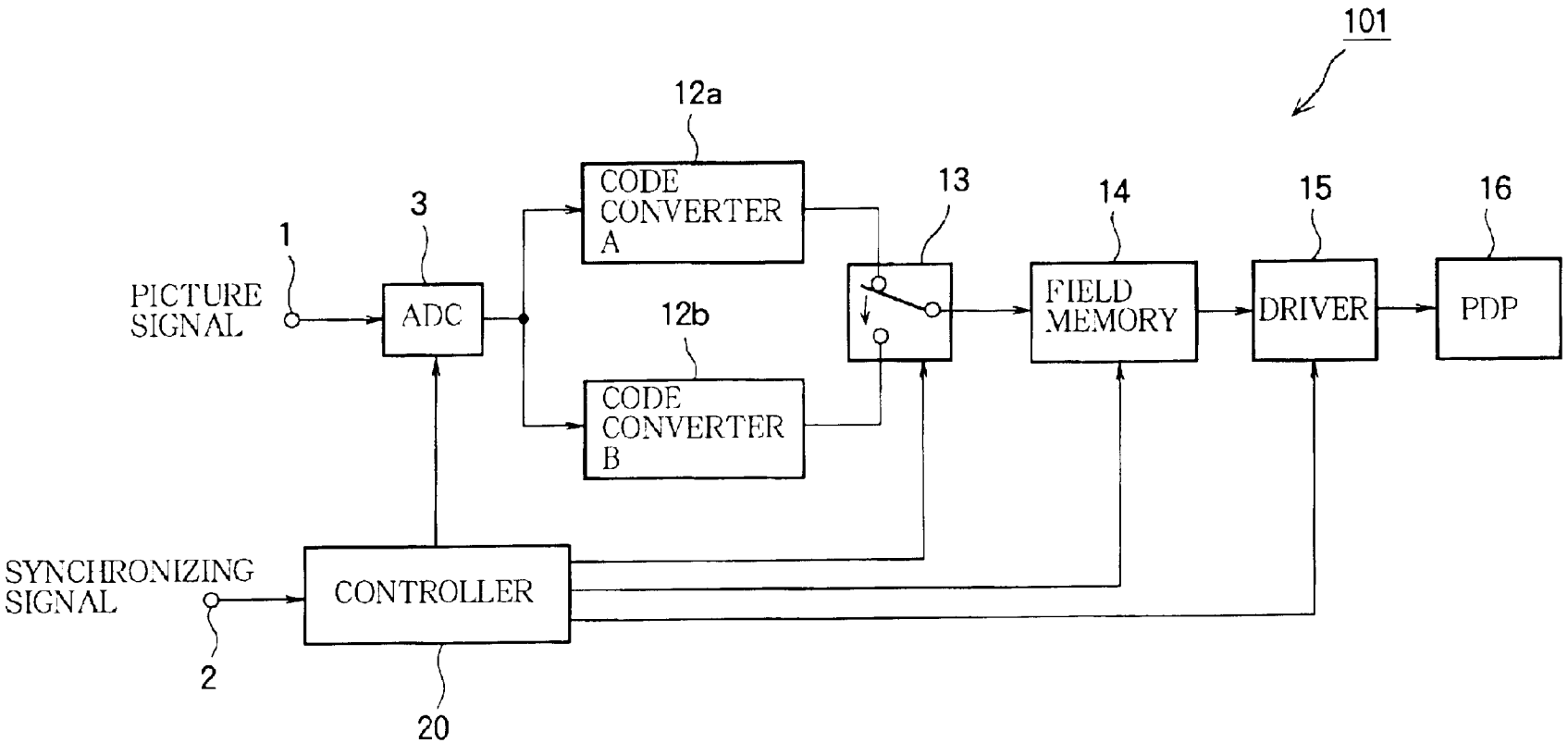
FIG.21 PRIOR ART
FIG. 21 is a block diagram of another conventional PDP display apparatus.
Figure 22A:
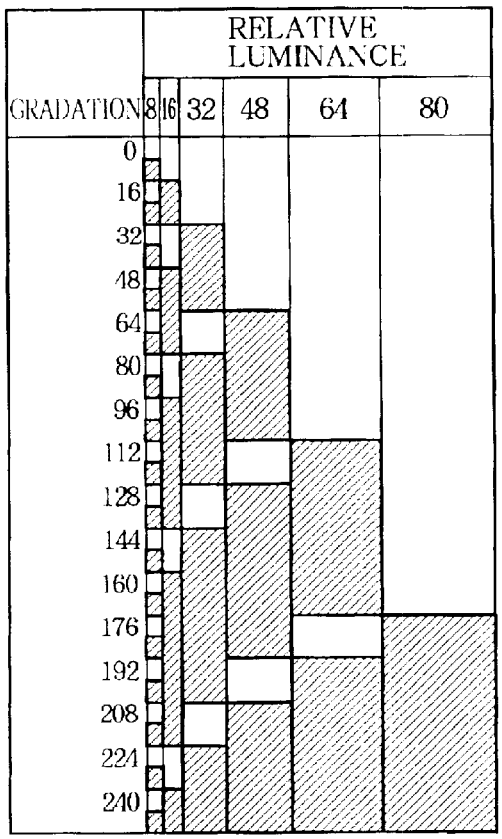
FIG.22A PRIOR ART
FIGS. 22A and 22B show the high-order bits of two sequences of nine-bit subfield patterns used by the display apparatus in FIG. 21.
Figure 22B:
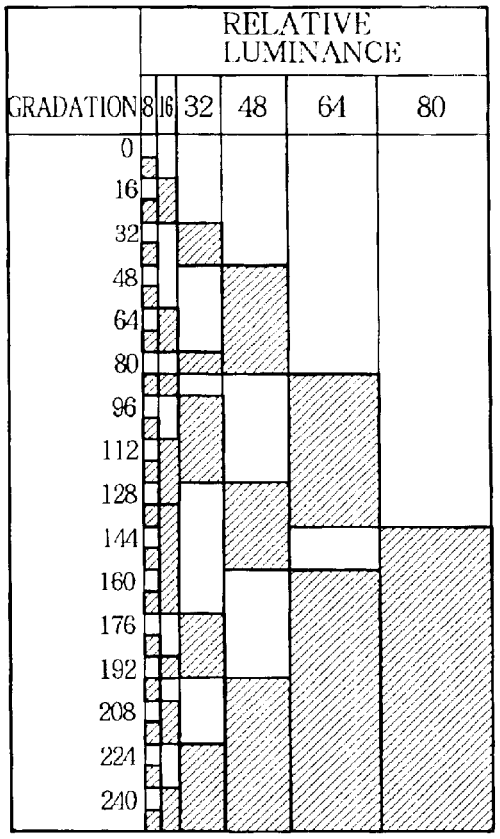
FIG.22B PRIOR ART
Figure 23:
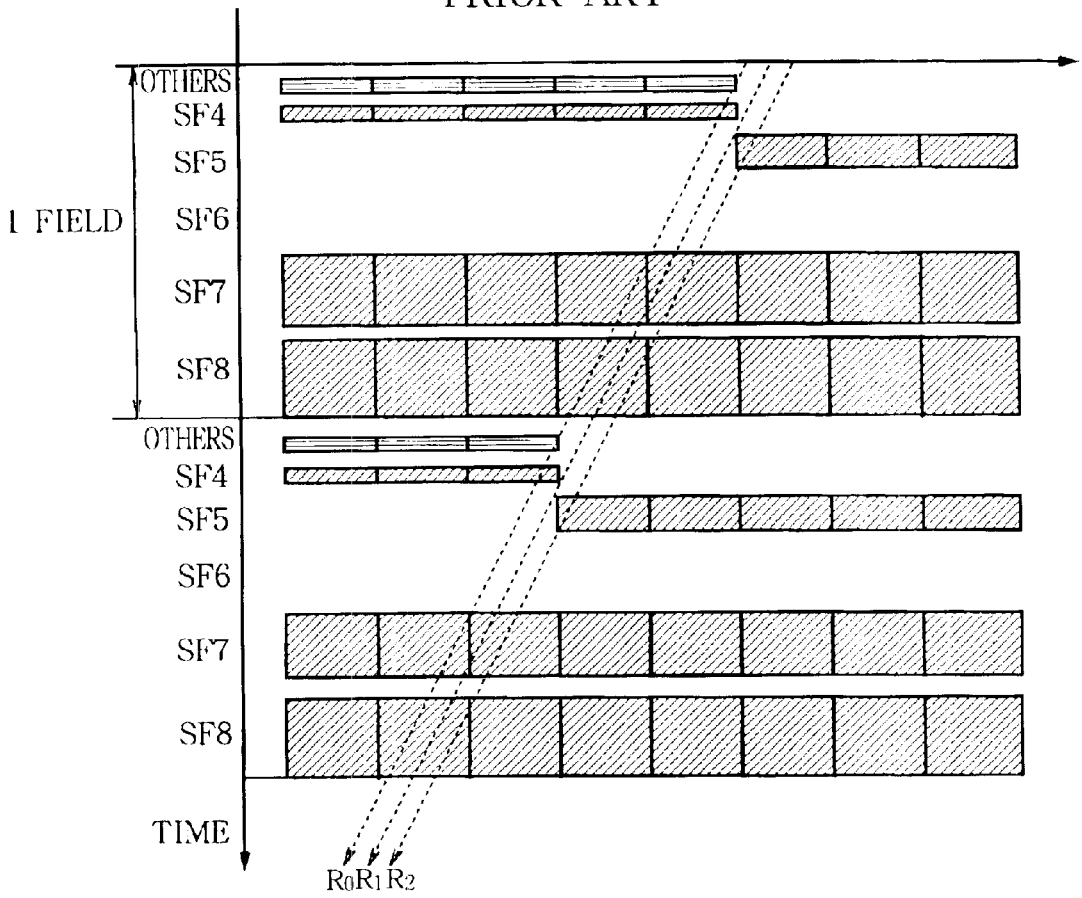
FIG.23 PRIOR ART
FIG. 23 shows the picture in FIG. 19 displayed by subfield patterns from the sequence in FIG. 22B.
Figure 24:
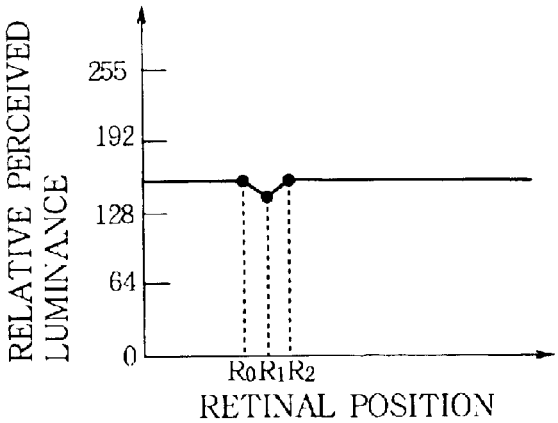
FIG.24 PRIOR ART
FIG. 24 shows the relationship between retinal position and perceived luminance gradation when a person views the picture in FIG. 23.

A signal delay unit 10 delays the digital picture output from the analog-to-digital converter 3 by a time T equivalent to the processing time in the rollover suppression processor 5, and supplies the delayed digital picture signal to a pair of code converters 12*a*, 12*b* similar to the ones in FIG. 21. The signal delay unit 10 comprises a storage device or memory circuit having a capacity corresponding to time T. A code conversion selector 13 selects the output of one code converter or the other according to the subfield sequence selection signal S, and supplies the selected output to a field memory 14 having a two-field capacity. A driver 15 reads the data stored in the field memory 14 and drives a PDP 16. The analog-to-digital converter 3, rollover suppression processor 5, signal delay unit 10, field memory 14, and driver 15 are controlled by the controller 4.

In the rollover suppression processor 5, the edge detector 6 detects edges in the digital picture signal by, for example, calculating the differences between the gradation values of adjacent pixels, and recognizing edges when these difference values are greater than a predetermined threshold value.

From the edge detection results, the non-edge area extractor 7 identifies picture areas that extend for at least a certain number of consecutive pixels in the horizontal and vertical directions, and do not include any edges. These are areas in which the gradation value varies smoothly. Normally, a picture includes a plurality of such areas, referred to below as non-edge areas, so the non-edge area extractor 7 numbers them in sequence, starting from one. The assigned numbers will be referred to below as area numbers. For each pixel, the non-edge area extractor 7 sends the gradation range calculator 8 the gradation value of the pixel and the area number of the non-edge area to which the pixel belongs. If the pixel does not belong to a non-edge area, its area number is set to zero.

For each non-edge area, the gradation range calculator 8 calculates the minimum and maximum gradation values in the area. The sequence selection controller 9 generates the subfield sequence selection signal S according to these minimum and maximum values, attempting to eliminate changes in high-order bit values if possible.

The code converters 12*a*, 12*b* and code conversion selector 13, constitute a code conversion unit, while the edge detector 6 and non-edge area extractor 7 constitute an area detector.

In the series of processes conducted by the rollover suppression processor 5, calculation of the minimum and maximum gradation values in each non-edge area consumes the most time. The gradation values of all pixels in a non-edge area are needed to calculate the minimum and maximum gradation values in that area. The time taken to process one non-edge area can therefore be as long as one field interval, if the non-edge area includes the first and last pixels in the field. The gradation range calculator 8 is structured so that its processing time is constant, not depending on the number of areas in the field or their sizes and shapes.

Figure 2:
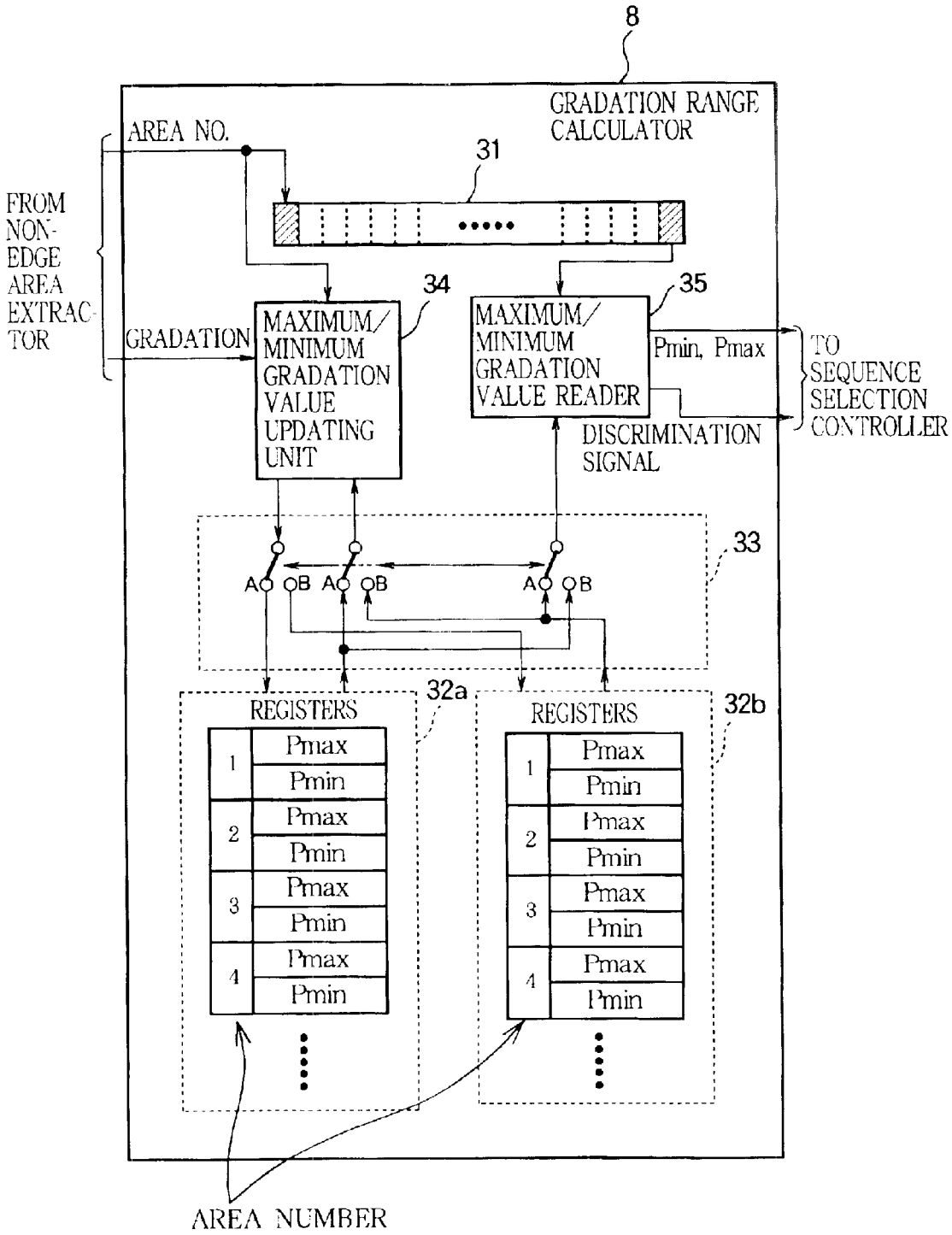
FIG. 2 is a block diagram showing the internal structure of the gradation range calculator in the first embodiment.

FIG. 2 shows the internal structure of the gradation range calculator 8. A first-in-first-out (FIFO) buffer 31 having a capacity equivalent to one field successively stores the area number of each pixel in the field. The minimum and maximum gradation values are written in two sets of registers 32*a*, 32*b*, indexed by area number. A switch 33 switches between access to register set 32*a* and register set 32*b* at the end of each field. A maximum/minimum gradation value updating unit 34 updates the minimum and maximum gradation values in the register sets 32*a*, 32*b*, based on the area number input from the non-edge area extractor 7 and the gradation value of the current pixel. A maximum/minimum gradation value reader 35 reads, and outputs to the sequence selection controller 9, the minimum and maximum gradation values in the non-edge area containing the pixel one field before, as indexed by the area number read from the FIFO buffer 31. The gradation range calculator 8 thus operates with a one-field delay: one field interval after the input of the gradation value and area number of a pixel from the non-edge area extractor 7, the gradation range calculator 8 outputs the minimum and maximum gradation values in the area to which the pixel belongs.

Two sets of registers are provided so that the calculated minimum and maximum gradation values can be retained until the next field. When the switch 33 is set to the A side in FIG. 2, the registers in register set 32*a* are used as working registers for calculating the minimum and maximum gradation values of non-edge areas in the current field, and the registers in register set 32*b* operate as read-only registers from which the minimum and maximum gradation values of non-edge areas in the preceding field are read. In the next field, the switch 33 is set to the B side, and the minimum and maximum gradation values are read from register set 32*a*, while register set 32*b* is used to calculate new minimum and maximum gradation values. The roles of register 32*a* and register 32*b* alternate at each field.

Next the operation of the display apparatus 50 will be described.

Referring again to FIG. 1, the analog-to-digital converter 3 converts the analog picture signal input from the picture-signal input terminal 1 to a digital picture signal comprising eight-bit digital codes. In the rollover suppression processor 5, the edge detector 6 detects edges and the non-edge area extractor 7 identifies and assigns numbers to the non-edge areas in each field. For each pixel in the picture, the non-edge area extractor 7 provides the gradation range calculator 8 with either the area number of the non-edge area to which the pixel belongs, or a zero value of indicating that the pixel is not part of any non-edge area.

The operation of the gradation range calculator 8 for a field in which the switch 33 is set to the A side, so that the registers in register set 32*a* are used as working registers, will be described with reference to FIG. 2. At the beginning of this field, the registers in register set 32*a* are cleared so that they all indicate a maximum gradation of zero and a minimum gradation value of 255.

First, the operation of the maximum/minimum gradation value updating unit 34 will be described. The maximum/minimum gradation value updating unit 34 receives the gradation values and area numbers of the pixels sequentially from the non-edge area extractor 7. Upon receipt of a non-zero area number, indicating that the current pixel belongs to a non-edge area, the maximum gradation value and the minimum gradation value detected so far in that non-edge area are read from the register indexed by the area number in register set 32*a*. The values thus read are compared with the gradation value of the current pixel. If the current gradation value is greater than the maximum gradation value detected so far, the maximum gradation value is updated to the current pixel value. If the current gradation value is smaller than the minimum gradation value, the minimum gradation value is updated to the current pixel value. The updated value is written back to the appropriate register in register set 32*a*. When this process has been carried out for all pixels in one field, the minimum and maximum gradation values of each non-edge area in the field are stored in register set 32*a*, indexed by area number.

The area numbers supplied to the maximum/minimum gradation value updating unit 34 are also written in the FIFO buffer 31. One field interval later, these area numbers are read from the FIFO buffer 31 by the maximum/minimum gradation value reader 35. For each non-zero area number, the maximum/minimum gradation value reader 35 reads the data from the corresponding registers in register set 32*b*, indicating the minimum and maximum gradation values of the non-edge area to which the current pixel belonged one field before. The maximum/minimum gradation value updating unit 34 outputs these minimum and maximum values to the sequence selection controller 9.

The maximum/minimum gradation value updating unit 34 also sends the sequence selection controller 9 a one-bit non-edge area discrimination signal, which is set to '1' when a non-zero area number is read from the FIFO buffer 31, and to '0' when a zero area number is read. When a zero area number is read, there are no minimum and maximum gradation values to output, so the maximum/minimum gradation value updating unit 34 sends the sequence selection controller 9 arbitrary data in place of minimum and maximum values.

Next, the operation of the sequence selection controller 9 in FIG. 1 will be described.

When the non-edge area discrimination signal received from the gradation range calculator 8 has a '1' value, indicating that the current pixel belonged to a non-edge area one field ago, the sequence selection controller 9 compares the minimum and maximum gradation values of that non-edge area, as received from the gradation range calculator 8, with the subfield sequences employed by the code converters 12*a* and 12*b*, and attempts to select a subfield sequence that can express the gradations in the area without changing the values of any high-order bits. This process will be described in detail with reference to FIGS. 3A and 3B.

FIG. 3A shows the subfield sequence SA used by code converter A 12*a*; FIG. 3B shows the subfield sequence SB used by code converter B 12*b*. For convenience, bits bb0 to bb8 are labeled with the corresponding subfield values SF0 to SF8. The subfields SF0 to SF8 are weighted with luminance (L) ratios of 1:2:4:8:16:32:48:64:80; that is, the lengths of their sustaining discharge intervals are proportional to these values, as in the conventional display apparatus 101 shown in FIG. 21.

The hatched portions in FIGS. 3A and 3B represent omitted values. For gradations (G) from 1 to 14 in sequence SA, for example, the bit values of subfields SF8 to SF4 remain constant at '0', while the bit values of subfields SF3 to SF0 vary from binary '0001' (decimal 1) to binary '1110' (decimal 14). Similarly, in the other omitted portions in FIGS. 3A and 3B, only the bit values of subfields SF3 to SF0 change.

Since subfield sequences SA and SB include subfields with weights that are not powers of two, in the range from gradation 48 to gradation 207, a plurality of subfield patterns are available to represent the same gradation value. Sequences SA and SB are structured so as to use different subfield patterns to represent many of these gradation values.

The dash-dot lines in FIGS. 3A and 3B indicate the locations of rollovers involving subfields SF5 to SF8, which have weights of 32 or higher. In the following description, these rollovers will be considered to be high-order rollovers. More precisely, a high-order rollover will be said occur when a change from one gradation value to the next-higher or next-lower gradation value causes a change in the on/off state of any subfield having a duration longer than the duration of subfield SF5. Equivalently, a high-order rollover could be defined as a change in the value of bit bb6, bb7, or bb8. If a rollover occurs when the gradation value changes from n to n+1, gradation n is referred to as a rollover gradation. The high-order rollover gradations in sequence SA are labeled CA1 to CA5, in order from smallest to largest; the high-order rollover gradations in sequence SB are labeled CB1 to CB6, in order from smallest to largest.

Sequences SA and SB have different high-order rollover gradations. For example, in sequence SA, the first high-order rollover gradation CA1 occurs at gradation 63; a rollover from SF5 (weight 32) to SF6 (weight 48) occurs when the gradation value changes from 63 to 64. In sequence SB, however, 63 is not a high-order rollover gradation. Sequence SB has no high-order rollover in the entire range of gradation values from 48 to 78. Sequences SA and SB are structured so that, in order from smallest to largest, their high-order rollover gradations occur alternately (CB1, CA1, CB2, CA2 . . . ) at intervals of sixteen gradations.

When the sequence selection controller 9 receives a maximum gradation value Pmax and a minimum gradation value Pmin from the gradation range calculator 8, if the non-edge area discrimination signal is '1', indicating that Pmax and Pmin are valid data representing the minimum and maximum gradation values in a non-edge area, Pmax and Pmin are compared with rollover gradations CAp (p=1 to 5) of sequence SA and rollover gradations CBq (q=1 to 6) of sequence SB. If $Pmin \leqq CX < Pmax$ is true for a rollover gradation CX, the gradation range of the non-edge area includes rollover gradation CX. If $Pmin \leqq CX < Pmax$ is true for only one rollover gradation CX, the sequence selection controller 9 selects the code converter with the subfield sequence that does not include CX.

FIGS. 4A and 4B show examples of the selection of a subfield sequence for a rectangular non-edge area. Each square represents a pixel; the number in the square represents the gradation value of the pixel.

Incidentally, the non-edge area extractor 7 is not restricted to extracting rectangular non-edge areas; a non-edge area in an actual picture may have various shapes, including irregular shapes.

FIG. 4A shows an example when the maximum gradation Pmax in the non-edge area is 175 and the minimum gradation Pmin is 144. This non-edge area includes rollover gradation CA4 (159) of sequence SA ($Pmin \leqq CA4 < Pmax$). If a moving picture including this non-edge area were to be displayed using subfield sequence SA, a pseudo-contour would be perceptible along the dash-dot line in FIG. 4A.

The relation $Pmin \leqq CBq < Pmax$ is not satisfied for any rollover gradation CBq (q=1 to 6) in sequence SB, however.

The sequence selection controller 9 therefore sets the subfield sequence selection signal S to a value that causes the code conversion selector 13 to select code converter B 12*b*, which uses subfield sequence SB. The sequence selection controller 9 performs this process separately for each pixel, but receives the same the minimum and maximum gradation values Pmin and Pmax for each pixel in this non-edge area, so sequence SB is selected for all pixels in this area. As a result, no high-order rollover occurs, and the pseudo-contour becomes substantially imperceptible.

In FIG. 4B, the maximum gradation Pmax is 180, and the minimum gradation Pmin is 149. Since Pmin≦CA4<Pmax is true for sequence SA and Pmin≦CB5<Pmax is true for sequence SB, a high-order rollover will occur regardless of whether sequence SA or sequence SB is selected. The dash-dot line in FIG. 4B indicates the location of the rollover when sequence SA is selected; the dotted line indicates the location of the rollover when sequence SB is selected.

Figure 25:
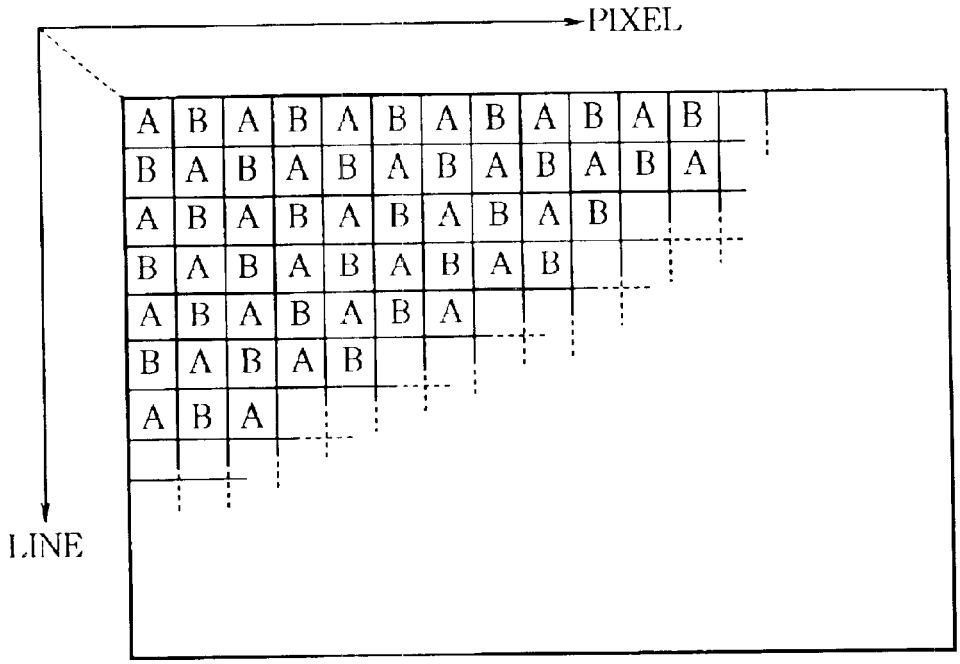
FIG. 25 PRIOR ART
FIG. 25 indicates which subfield sequence is selected for the display of each pixel on the PDP screen by the conventional display apparatus in FIG. 21.
Figure 26:
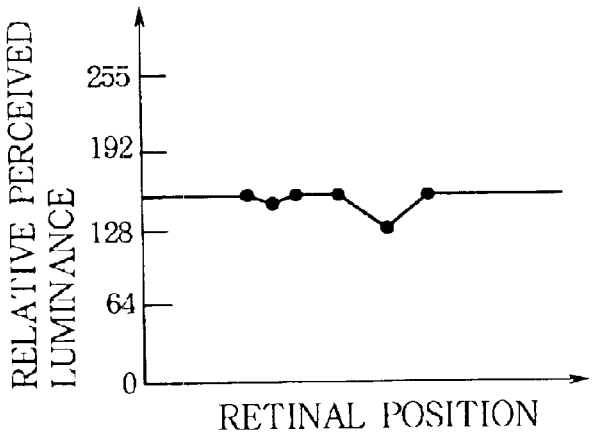
FIG. 26 PRIOR ART
FIG. 26 illustrates the pseudo-contour mitigation effect of the selection scheme in FIG. 25.

To reduce moving-picture pseudo-contours in cases like this, in which a non-edge area contains rollover gradations for both sequences, the sequence selection controller 9 changes the value of the subfield sequence selection signal at intervals of h pixels in the horizontal direction (h≧1) and v pixels in the vertical direction (v≧1). Due to an effect similar to that illustrated in FIGS. 25 and 26 for the conventional display apparatus 101, the temporal center of gravity of light emission is dispersed, so that instead of perceiving one relatively prominent pseudo-contour, the eye perceives two relatively minor pseudo-contours.

The sequence selection controller 9 accordingly outputs the subfield sequence selection signal S according to the following rules 1 and 2.

Rule 1: If a non-edge area contains a high-order rollover gradation in one sequence (SA or SB) but not in the other sequence, the sequence without the high-order rollover gradation is selected for all pixels in the non-edge area.

Rule 2: If a non-edge area contains high-order rollover gradations in both sequences SA and SB, then within that non-edge area, the selected sequence is switched every h pixels (h≧1) in the horizontal direction and every v pixels (v≧1) in the vertical direction.

When a non-edge area contains no high-order rollover gradation in either sequence SA or SB, or when the non-edge area discrimination signal is '0', indicating that the current pixel does not belong to any non-edge area, either sequence SA or SB is selectable. In this case, the sequence selection controller 9 switches the sequence selection at intervals of one pixel in both the horizontal and vertical directions. Since sequences SA and SB have the same rollover positions in subfields with weights less than 32, this switching has relatively little effect in non-edge areas in which rollovers occur only in those subfields, but the switching is still desirable because it disperses the temporal center of gravity of light emission.

Referring once again to FIG. 1, code converter A 12*a* and code converter B 12*b* convert the digital picture signal to nine-bit codes corresponding to the subfield patterns in sequences SA and SB, respectively. For each pixel P, the code conversion selector 13 selects one of the two subfield patterns output from the code converters, according to the subfield sequence selection signal S. Since the signal delay unit 10 delays the digital picture signal by a time equal to the processing time T of the rollover suppression processor 5, the subfield sequence selection signal S(P) input to the code conversion selector 13 for a pixel P in a given field is synchronized with the input of the gradation value of pixel P to the code converters 12*a*, 12*b*. The code conversion selector 13 thus selects the subfield pattern taken from the subfield sequence selected by the sequence selection controller 9.

As noted above, the processing time of the gradation range calculator 8 in the rollover suppression processor 5 is constant regardless of the result of area extraction. The other processing performed by the rollover suppression processor 5 is also carried out in constant time, so that the total processing time T is constant. As the processing time of the gradation range calculator 8 occupies the largest part of the total time T, the memory capacity of the signal delay unit 10 is on the order of one field interval.

The rest of the operation is the same as in a conventional display apparatus. The field memory 14 stores the code-converted subfield patterns alternately in two memory areas, each having a one-field capacity. If the bits of a subfield pattern are bb0, bb1, bb2, bb3, bb4, bb5, bb6, bb7, and bb8, respectively, then to display a field, the driver 15 begins by reading the bb0 data for all pixels from one memory area, and writing the data, constituting the bb0 bit plane, into the PDP 16 during the addressing interval of subfield SF0, under control of the controller 4. In the PDP 16, the pixels for which bb0 is '1' emit light during the sustaining discharge interval of subfield SF0. Subfields SF1 to SF8 are displayed in the same way, one after another, the bb1 to bb8 bit planes being written into the PDP 16 via the driver 15 in the addressing intervals, and light being emitted in the sustaining discharge intervals.

By using subfield sequences SA and SB selectively as described above, the display apparatus 50 in the first embodiment is able to eliminate rollover in the high-order bit positions (bb5 to bb8, corresponding to subfields SF5 to SF8) from all non-edge areas in which the total range of gradation variation is less than sixteen gradation levels (Pmax−Pmin<16). Rollover is also eliminated from some non-edge areas with gradation ranges as wide as thirty-one gradation levels (16≦Pmax−Pmin≦31). The gradation levels of a non-edge area are typically confined to a narrow range, so the proportion of non-edge areas from which high-order rollover is eliminated in the first embodiment is quite high. The remaining high-order rollover is mainly concentrated in parts of the picture having sharp gradation variations (edges). Pseudo-contours are not readily perceptible in edge areas, because they are disguised by the true edge contours, so the remaining high-order rollover does not cause significant degradation of picture quality.

In edge areas, and non-edge areas from which high-order rollover cannot be eliminated, by switching between sequences SA and SB, the first embodiment provides the same type of pseudo-contour mitigation as provided by the conventional display apparatus 101. Accordingly, the first embodiment always provides at least the same degree of pseudo-contour mitigation as the conventional display apparatus, and typically provides a much greater mitigation effect, by eliminating high-order rollover from most non-edge areas.

Two sequences SA and SB were used in the first embodiment, but it is possible to use three or more sequences, as in the second embodiment, described next.

Figure 5:
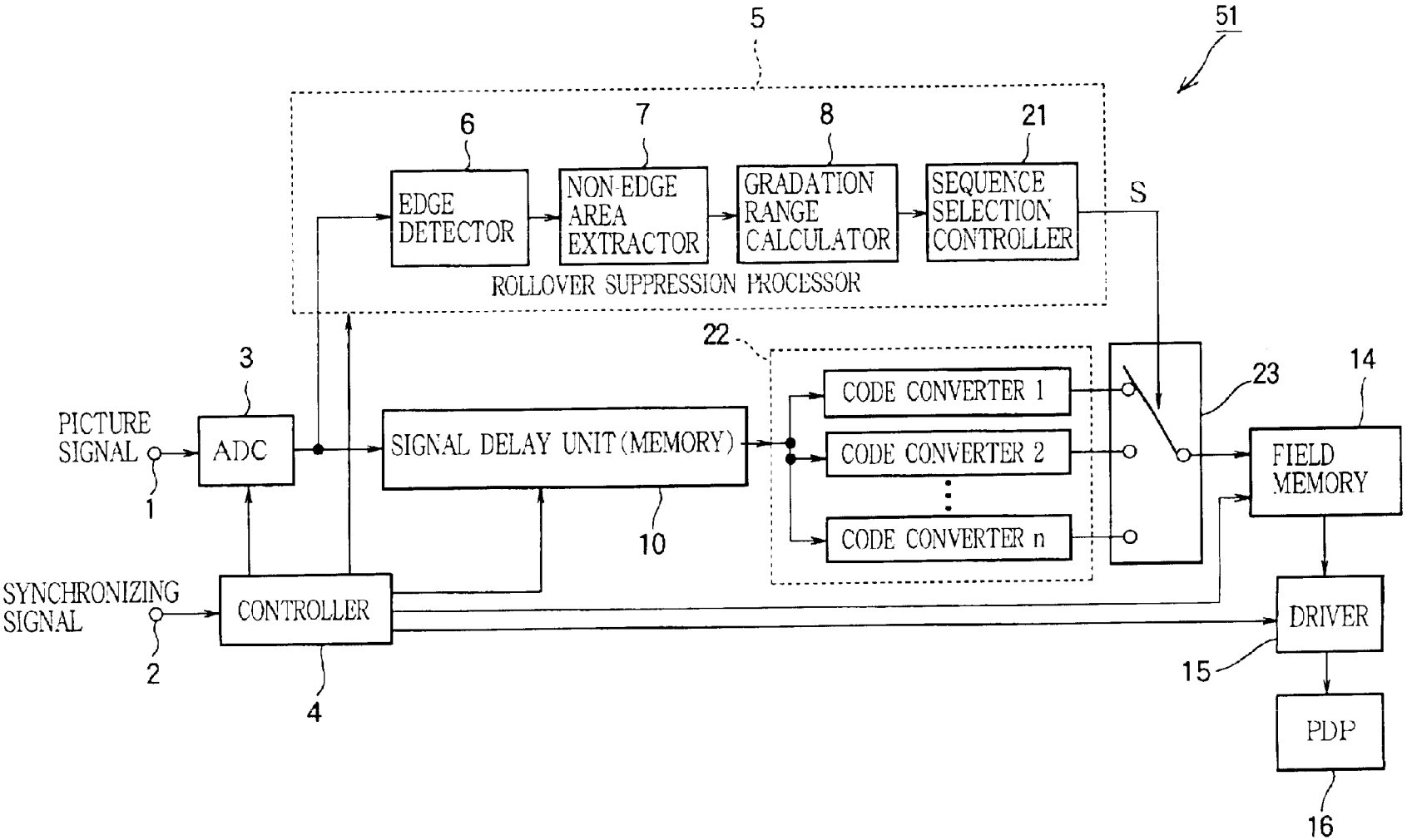
FIG. 5 is a block diagram of a PDP display apparatus illustrating a second embodiment of the invention.

Referring to FIG. 5, the display apparatus 51 in the second embodiment differs from the display apparatus 50 in first embodiment in regard to the structure and operation of the sequence selection controller 21, code converters 22, and code conversion selector 23. The following description will focus on these component elements; the other component elements of the display apparatus 51 operate as described in the first embodiment.

The code converter group 22 includes n code converters, where n is an integer greater than two. Each code converter uses a different subfield sequence to convert the digital moving-picture signal received from the signal delay unit 10 from eight-bit to nine-bit code values. Each subfield sequence has a different set of high-order rollover gradations. For each pixel, the code conversion selector 23 selects and outputs one of the n nine-bit subfield patterns received from the code converter group 22. The sequence selection controller 21 generates a subfield sequence selection signal S that controls the selection.

In the operation of the display apparatus 51 of the second embodiment, an analog picture signal is input at the input terminal 1 and processed by the analog-to-digital converter 3, edge detector 6, non-edge area extractor 7, gradation range calculator 8, and signal delay unit 10 as described in the first embodiment. The controller 4 also operates as in the first embodiment.

Whereas the sequence selection controller 9 in the first embodiment selected one of two subfield sequences SA and SB, the sequence selection controller 21 in the second embodiment selects one of n sequences, but the selection process is basically the same. For each non-edge area, the sequence selection controller 21 compares the high-order rollover gradations in each subfield sequence with the minimum and maximum gradation values (Pmin and Pmax) of the area. If just one of the n subfield sequences has no high-order rollover in the range from Pmin and Pmax, the sequence selection controller 21 selects that sequence. If two of the n subfield sequences are free of high-order rollover in this range, they are selected in turn, so that the selected sequence alternates in both the horizontal and vertical directions.

Similarly, if there are three subfield sequences SA, SB, SC that are free of high-order rollover in the range from Pmin to Pmax, these sequences SA, SB, and SC are selected cyclically in the horizontal and vertical directions, to maximize the dispersion of the center of gravity of light emission. Alternatively, the selection may alternate between two of the three sequences.

If there are no subfield sequences that are free of high-order rollover in the range from Pmin to Pmax, or if the current pixel does not belong to a non-edge area, then the selection cycles among all n subfield sequences, again dispersing the center of gravity of light emission. Alternatively, the selection may cycle among a subset of two or more of the n sequences.

While the sequence selection controller 21 is selecting one of the n subfield sequences for each pixel, the n code converters in the code converter group 22 use all n subfield sequences to generate and output n subfield patterns. The code conversion selector 23 then selects one of the n output subfield patterns according to the subfield sequence selection signal S received from the sequence selection controller 21, and sends the selected subfield pattern to the field memory 14. The field memory 14, driver 15, and PDP 16 operate as in the first embodiment, and the picture is displayed on the PDP 16.

Since the display apparatus 51 in the second embodiment has more subfield sequences to select from than the display apparatus 50 of the first embodiment, it has a higher probability of being able to select a subfield sequence with no high-order rollover, and can thus suppress pseudo-contours even more effectively than in the first embodiment.

Whereas the preceding embodiments extracted non-edge areas from a whole field, the necessary amount of memory and buffer circuitry can be reduced by extracting non-edge areas on a line-by-line basis, as in the third embodiment, described below.

The display apparatus in the third embodiment has the same basic structure as the display apparatus 50 in the first embodiment, shown in FIG. 1, but the signal processing in the non-edge area extractor 7', gradation range calculator 8', and signal delay unit 10' differs from the signal processing in the first embodiment. The following description will focus on the differences.

When consecutive non-edge pixels occur in a horizontal raster line on the screen of the PDP 16, the non-edge area extractor 7' of the third embodiment places them in the same non-edge area. Since there are typically a plurality of non-edge areas in one line, each non-edge area is numbered as in the first embodiment.

The gradation range calculator 8' in the third embodiment calculates the minimum and maximum value of the gradations in each non-edge area in the raster line, by the process described in the first embodiment. The maximum size of a non-edge area is one raster line, so the processing time of the gradation range calculator 8' is substantially one line interval, much less than in the first embodiment.

Figure 6:
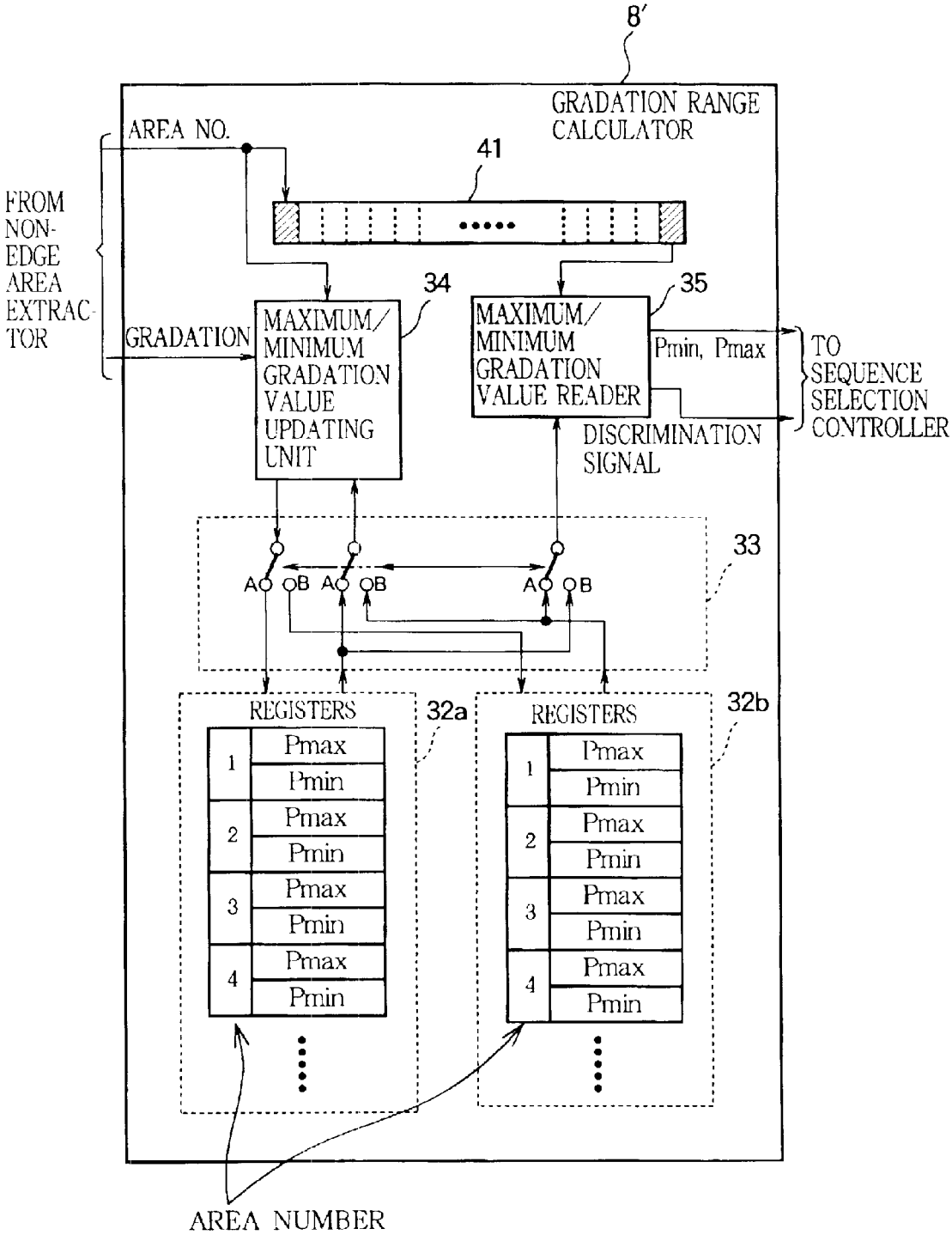
FIG. 6 is a block diagram showing the internal structure of the gradation range calculator in the second embodiment.

FIG. 6 illustrates the internal structure of the gradation range calculator 8' in the third embodiment. The block structure is generally the same as in the first embodiment (FIG. 2), but while the capacity of the FIFO buffer 31 in the first embodiment is equivalent to one field, the capacity of the FIFO buffer 41 in the third embodiment is equivalent to one raster line. Accordingly, the maximum/minimum gradation value reader 35 reads the area number of a pixel in the preceding line from the FIFO buffer 41, and the maximum/minimum gradation value reader 35 reads the minimum and maximum gradation values of the indicated area in the preceding line from register set 32*a* or 32*b*. The switch 33 switches between the two register sets 32*a*, 32*b* at the end of each line.

The signal delay unit 10' in the third embodiment provides a delay corresponding substantially to one line, because the processing time of the rollover suppression processor 5 corresponds to substantially one raster line.

Other operations in the third embodiment are carried out as described in the first embodiment.

Since processing is performed line by line in the third embodiment, the suppression of pseudo-contours when an object moves in the vertical direction on the screen is weaker than in the first embodiment; nevertheless, pseudo-contours are reduced more effectively than in a conventional display apparatus.

Since the FIFO buffer 41 in the gradation range calculator 8' has a capacity of only one line instead of one field, and the memory capacity of the signal delay unit 10' is also substantially one line instead of one field, the third embodiment requires much less memory than the first embodiment, and can be implemented in a smaller and therefore less expensive integrated circuit. Thus the third embodiment reduces the cost of suppressing moving-picture pseudo-contours, as compared with the first embodiment.

The gradation range calculator 8 and signal delay unit 10 in the second embodiment can also be modified to operate line-by-line, instead of field-by-field, with the same cost-reduction effect.

To eliminate high-order rollover from a non-edge area, the preceding embodiments change the subfield sequence, but it is also possible to eliminate high-order rollover by slightly modifying the contents of the non-edge area, without changing the subfield sequence, as in the fourth embodiment, described below.

Figure 7:
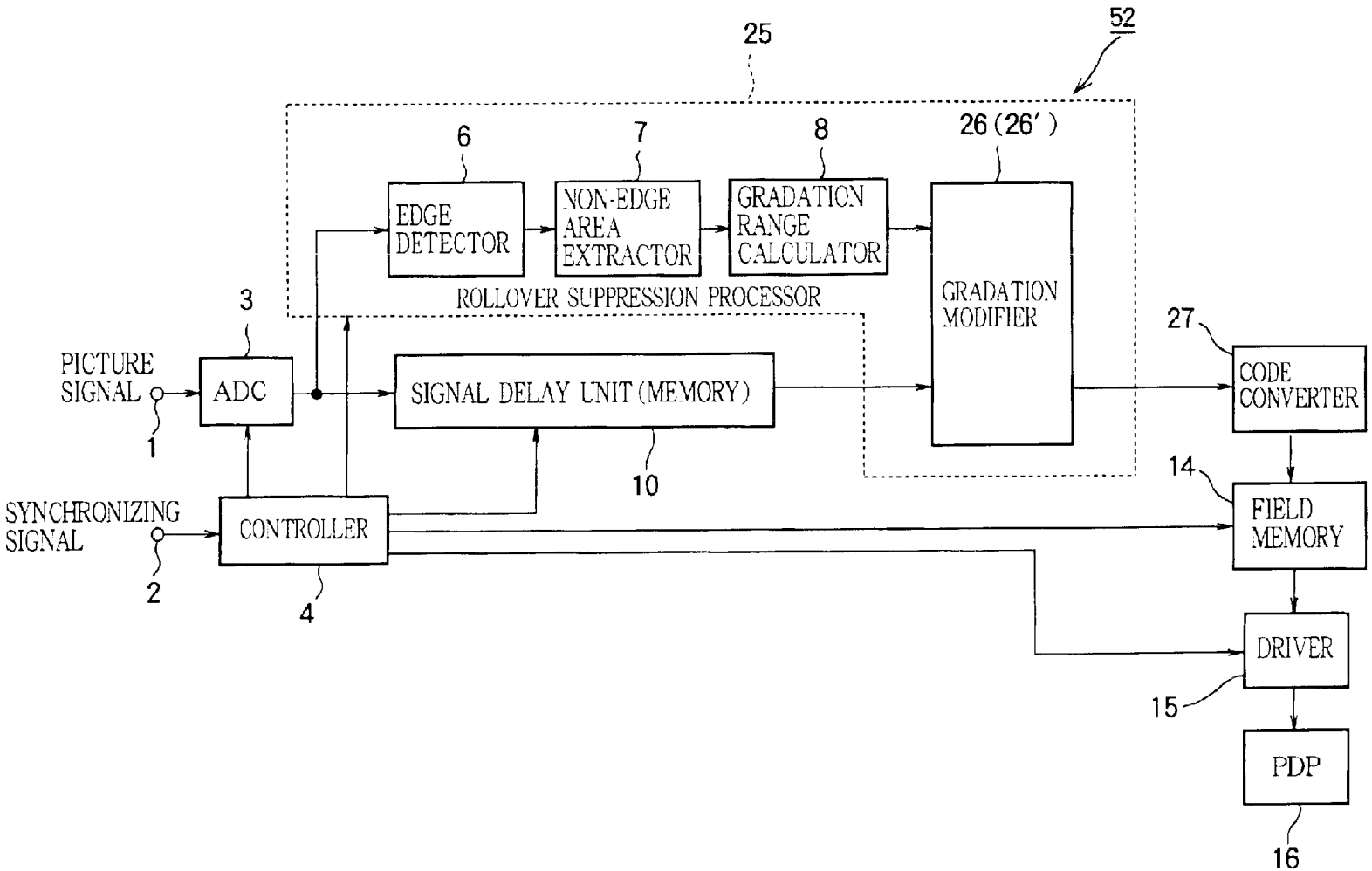
FIG. 7 is a block diagram of a PDP display apparatus illustrating fourth and fifth embodiments of the invention.

Referring to FIG. 7, the display apparatus 52 in the fourth embodiment has a picture signal input terminal 1, a synchronizing signal input terminal 2, an analog-to-digital converter 3, a controller 4, a signal delay unit 10, a field memory 14, a driver 15, and a PDP 16 that are similar to the corresponding elements in the first embodiment, and has a rollover suppression processor 25 that modifies the digital picture signal so as to suppress high-order rollover.

The rollover suppression processor 25 comprises an edge detector 6, a non-edge area extractor 7, and a gradation range calculator 8, which operate as in the first embodiment. The rollover suppression processor 25 also includes a gradation modifier 26, which receives the outputs of the gradation range calculator 8 and signal delay unit 10, and generates a modified digital picture signal. The signal delay unit 10 accordingly delays the digital picture signal by an amount corresponding to the total processing time in the edge detector 6, non-edge area extractor 7, and gradation range calculator 8.

A single code converter 27 converts the modified digital picture signal output from the rollover suppression processor 25 to nine-bit codes representing subfield patterns taken from a single subfield sequence, and stores the converted signal in the field memory 14, which has a two-field capacity.

In this embodiment, the gradation modifier 26 and signal delay unit 10 constitute a gradation modification unit.

Next, the operation of the display apparatus 52 will be described.

After the analog-to-digital converter 3 converts the analog input picture signal to a digital picture signal comprising eight-bit digital codes, the edge detector 6, non-edge area extractor 7, and gradation range calculator 8 divide the picture into numbered areas and find the minimum and maximum gradation values in each non-edge area, as in the first embodiment. As the gradation modifier 26 receives each pixel gradation value from the signal delay unit 10, it also receives from the gradation range calculator 8 a minimum gradation value, a maximum gradation value, and a non-edge area discrimination signal indicating whether the pixel belongs to a non-edge area or not. If the pixel belongs to a non-edge area, the minimum and maximum gradation values are the minimum and maximum gradation values in the non-edge area. If the pixel does not belong to a non-edge area, the minimum and maximum gradation values are meaningless.

If the pixel belongs to a non-edge area, if necessary, the gradation modifier 26 modifies the gradation value of the pixel to suppress high-order rollover in that area.

Figure 8:
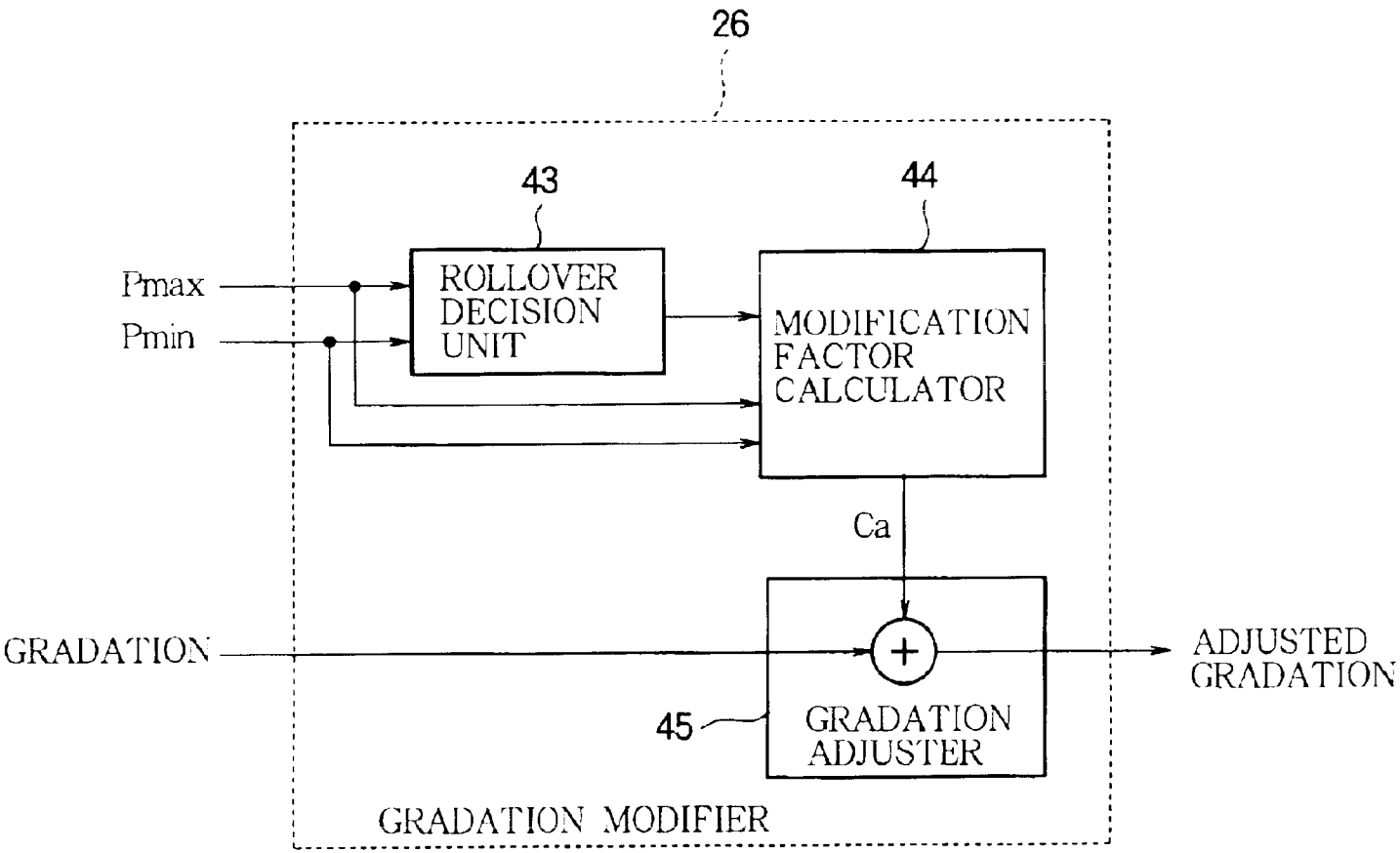
FIG. 8 is a block diagram illustrating the internal structure of the gradation modifier in the fourth embodiment.

FIG. 8 illustrates the internal structure of the gradation modifier 26. A rollover decision unit 43 decides whether or not a high-order rollover will occur in each non-edge area if the gradation levels in the area are not modified, and whether the rollover is removable. For each removable high-order rollover, a modification factor calculator 44 calculates a gradation modification factor Ca that can be added to the gradation values in the non-edge area to eliminate the rollover. The addition is performed by a gradation adjuster 45.

To decide whether or not a high-order rollover will occur, the rollover decision unit 43 compares the maximum gradation value Pmax and minimum gradation value Pmin of the non-edge area with the high-order rollover gradations in the subfield sequence used by the code converter 27, and determines whether there is a high-order rollover gradation CX for which $Pmin \leqq CX < Pmax$. To decide whether the rollover is removable, the rollover decision unit 43 determines whether the difference between Pmax and Pmin is less than the difference between CX and the next higher or next lower high-order rollover gradation. If the code converter 27 uses sequence SA in FIG. 3*a*, for example, the rollover is removable if the difference between Pmax and Pmin is less than thirty-two ($Pmax-Pmin<32$).

If the rollover is removable, the modification factor calculator 44 calculates a gradation modification factor Ca as illustrated in the following examples.

Figure 9A:
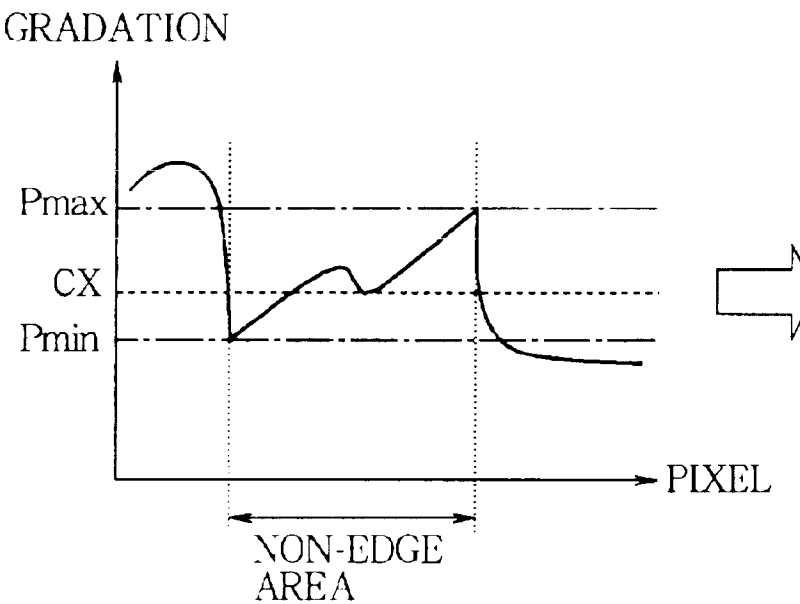
FIGS. 9A and 9B show an example of the operation of the gradation modifier in the fourth embodiment.
Figure 9B:
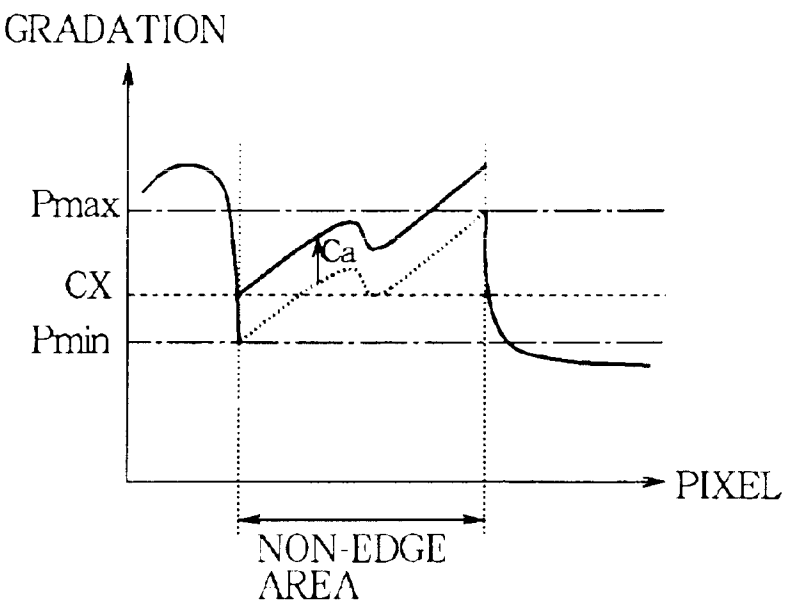

FIGS. 9A and 9B illustrate the removal of a rollover by the addition of a positive modification factor Ca. FIG. 9A is a graph representing gradation values before the modification. FIG. 9B shows these unmodified gradation values as a dotted line, and the modified gradation values as a solid line. In both graphs, pixel position is represented on the horizontal axis, and gradation value on the vertical axis. CX is a high-order rollover gradation occurring between the maximum gradation value Pmax and minimum gradation value Pmin of a non-edge area indicated on the horizontal axis. For simplicity, the non-edge area is considered to be one-dimensional.

In FIG. 9A, the rollover gradation CX is nearer to the minimum gradation value Pmin than to the maximum gradation value Pmax ($Pmax-CX>CX-Pmin$). The gradation values in the area are therefore shifted in the positive (upward) direction by a modification factor Ca equal to $CX-Pmin$. As seen in FIG. 9B, the addition of Ca makes all the gradation values in the non-edge area equal to or greater than the high-order rollover gradation CX, thereby eliminating the rollover.

Figure 10A:
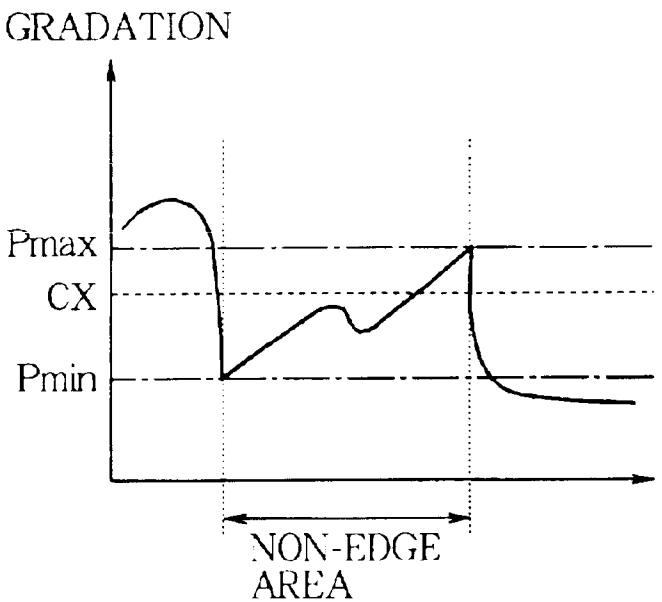
FIGS. 10A and 10B show another example of the operation of the gradation modifier in the fourth embodiment.
Figure 10B:
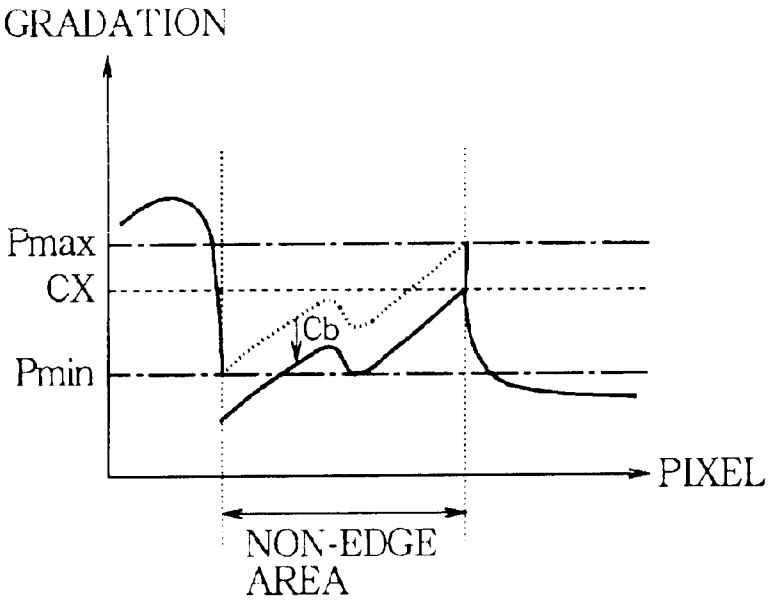

FIGS. 10A and 10B are similar graphs illustrating the removal of a rollover by the addition of a negative modification factor Ca, FIG. 10A showing the unmodified gradation values, FIG. 10B showing the modification. When the rollover gradation CX is nearer to the maximum gradation value Pmax than to the minimum gradation value Pmin, (more precisely, when $Pmax-CX \leqq CX-Pmin$), the modification factor Ca is set equal to $-(Pmax-CX)$. After the modification, all gradation values in the non-edge area are equal to or less than the rollover gradation CX.

To avoid an unnatural picture, the modification factor Ca is limited to values equal to or less than a predetermined maximum modification value. If it would be necessary to modify the gradation values by more than this maximum value in order to eliminate the rollover, no modification is performed ($Ca=0$). This may occur if Pmax and Pmin are widely separated and CX is substantially halfway between them, for example.

The code converter 27 converts the digital picture signal output from the gradation modifier 26 to subfield patterns by using, for example, sequence SA in FIG. 3A, as mentioned above. Alternatively, the code converter 27 may use sequence SB in FIG. 3B, or any other sequence.

The field memory 14 stores the code-converted subfield patterns alternately in two field memories, as in the first embodiment. If the bits of a subfield pattern are bb0, bb1, bb2, bb3, bb4, bb5, bb6, bb7, and bb8, then the driver 15 first writes the bb0 bit plane of one field into the PDP 16, then writes the bb1 bit plane of the same field into the PDP 16, and continues in this fashion through bb8. The writing of each bit plane is followed by a sustaining discharge interval in which the pixels with '1' data emit light.

As noted above, the gradations in a non-edge area are typically confined to a narrow range of values, so if the range includes a high-order rollover gradation, it can usually be eliminated by a relatively slight modification Ca. The fourth embodiment is therefore able to suppress pseudo-contours in most smoothly varying parts of a moving picture without significantly altering the content of the picture.

Figure 13:
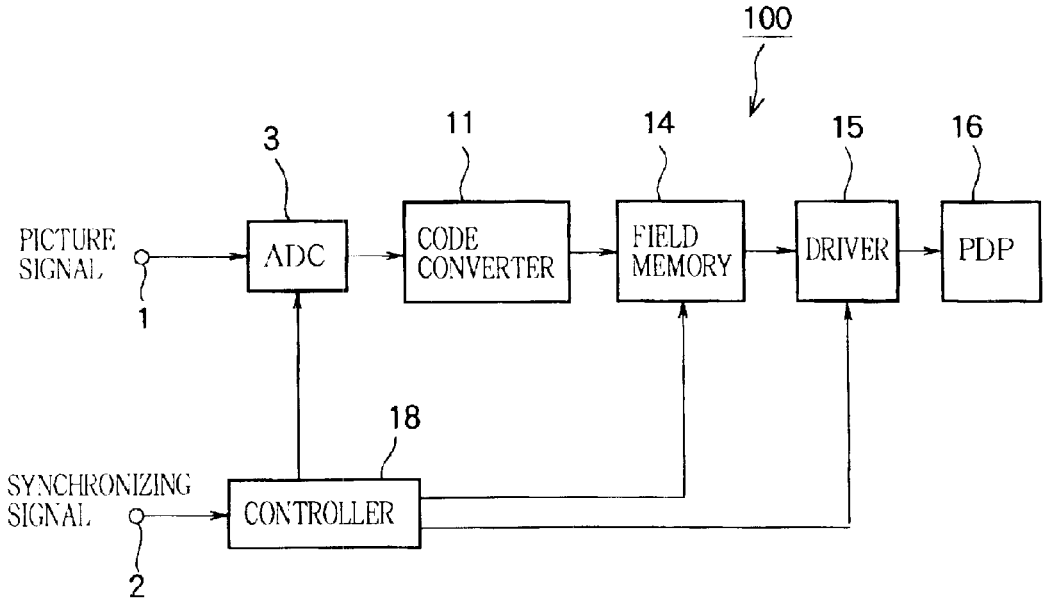
FIG.13 PRIOR ART
FIG. 13 is a block diagram of a conventional PDP display apparatus.
Figure 14:
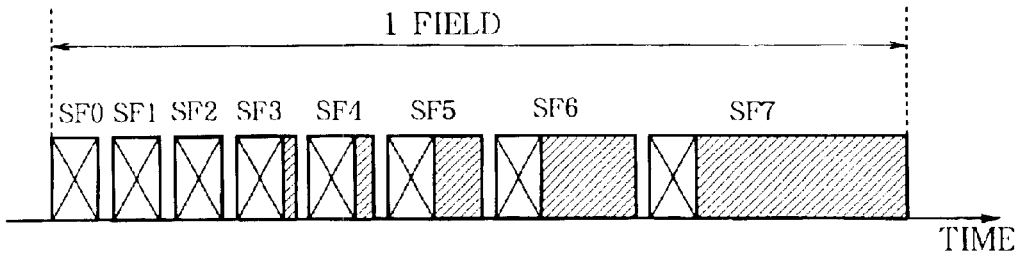
FIG.14 PRIOR ART
FIG. 14 illustrates the division of a field interval into eight subfields.
Figure 15:
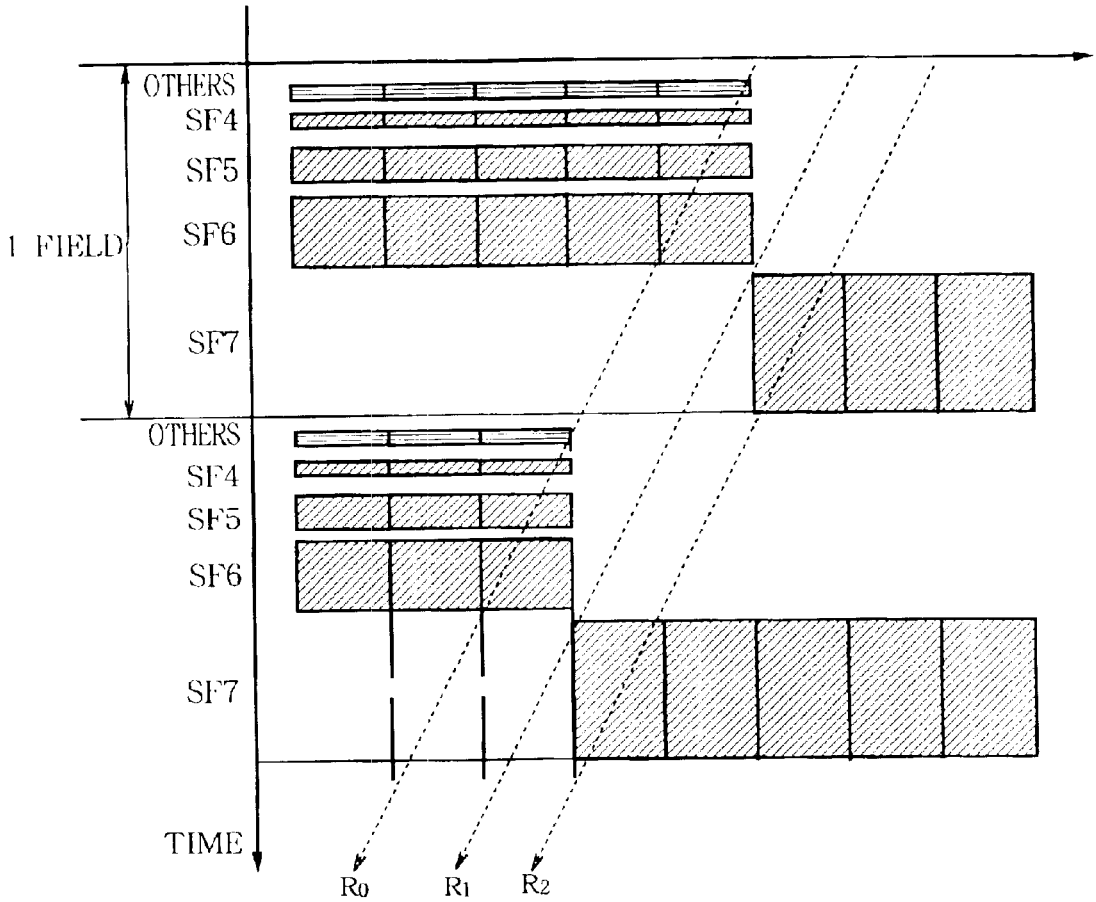
FIG.15 PRIOR ART
FIG. 15 shows a subfield light emission sequence that leads to the perception of a pseudo-contour.
Figure 16:
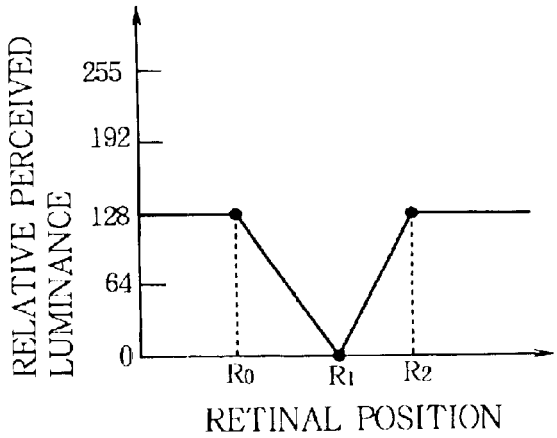
FIG.16 PRIOR ART
FIG. 16 shows the relationship between retinal position and perceived luminance gradation when a person views the picture in FIG. 15.
Figure 17:
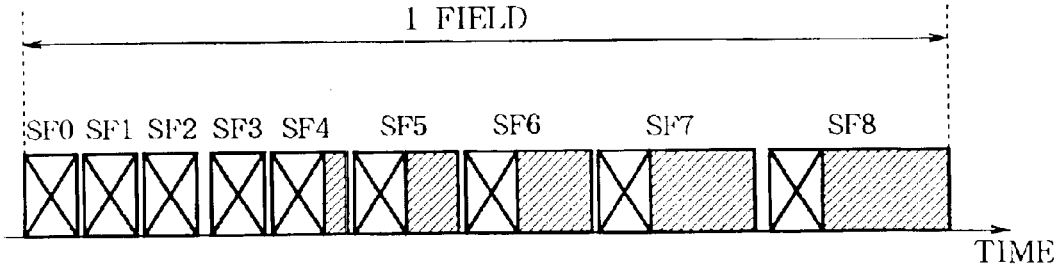
FIG.17 PRIOR ART
FIG. 17 illustrates the division of a field interval into nine subfields.
Figure 18:
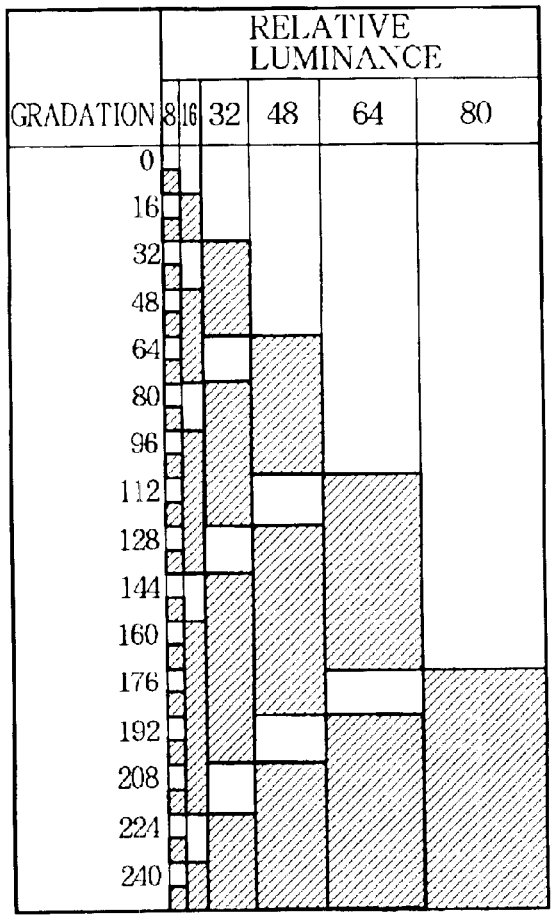
FIG.18 PRIOR ART
FIG. 18 shows the high-order bits of a sequence of nine-bit subfield patterns that obeys the rollover rule.
Figure 19:
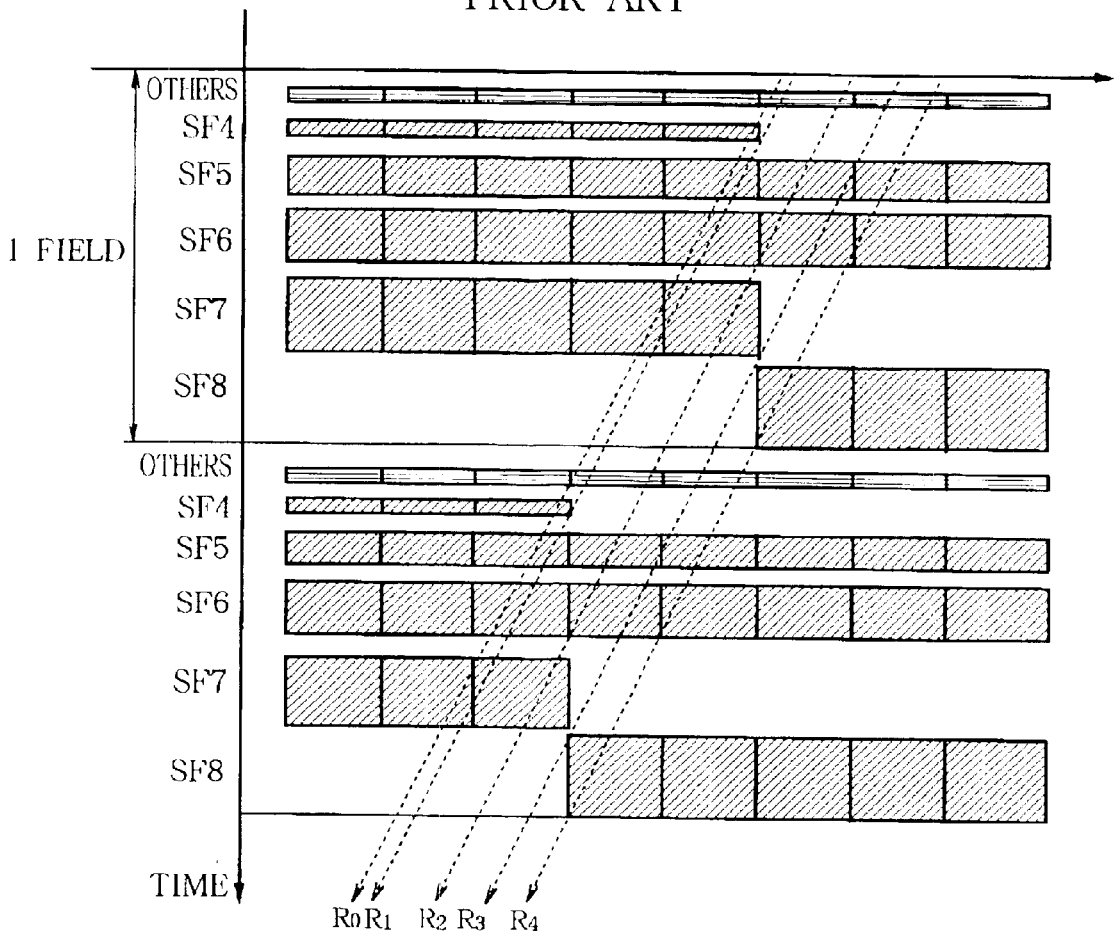
FIG. 19 PRIOR ART
FIG. 19 shows a light emission sequence having a rollover in the most significant bit position in FIG. 18.
Figure 20:
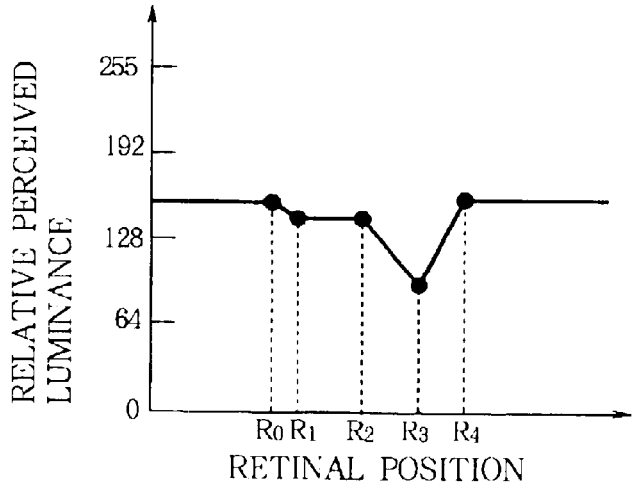
FIG. 20 PRIOR ART
FIG. 20 shows the relationship between retinal position and perceived luminance gradation when a person views the picture in FIG. 19.

Since the fourth embodiment requires only one subfield sequence, it can be implemented by adding a rollover suppression processor and a signal delay unit to a conventional display apparatus of the type shown in FIG. 13, enabling the invention to be practiced in display apparatus that is already in use.

In a variation of the fourth embodiment, the code converter 27 is omitted and the picture is displayed according to the modified eight-bit picture signal, with eight subfields having sustaining discharge interval lengths proportional to powers of two.

The display apparatus 52 in the fourth embodiment modified the digital picture signal by use of an additive modification factor, but it is possible to obtain a more natural modified picture by performing more complex types of modification, as in the fifth embodiment, described below.

The display apparatus in the fifth embodiment has the same basic structure as the display apparatus 52 in the fourth embodiment, shown in FIG. 7, but the gradation modifier 26' eliminates high-order rollover by compressing the gradation range in a non-edge area, instead of by additively shifting the gradation range up or down. The following description will focus on this difference, with reference to the block diagram in FIG. 7 and the graphs in FIGS. 11A, 11B, 12A, and 12B.

Figure 11A:
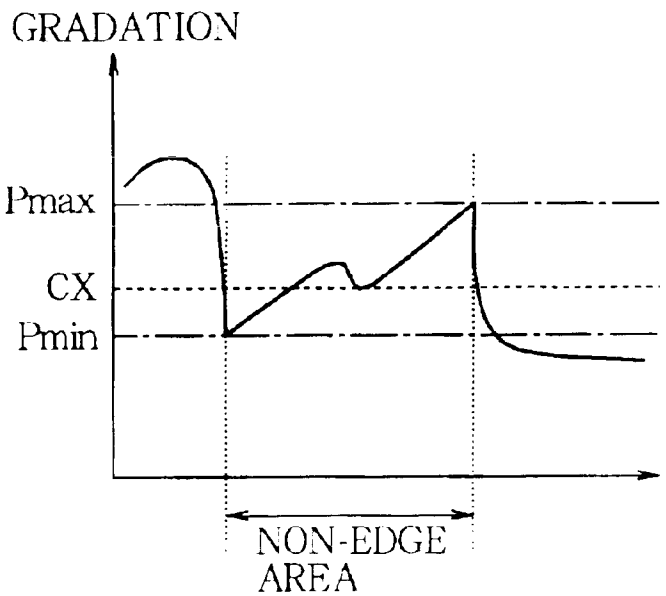
FIGS. 11A and 11B show an example of the operation of the gradation modifier in the fifth embodiment.
Figure 11B:
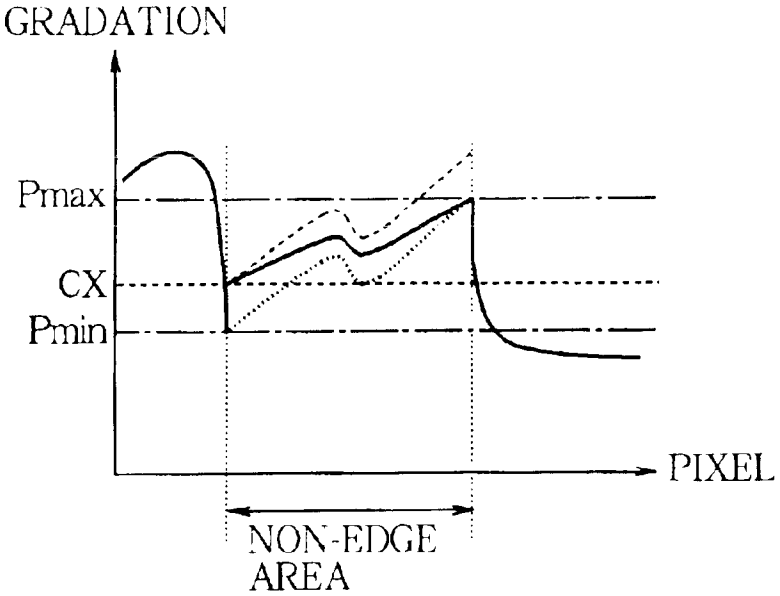

The graph in FIG. 11A shows the same digital picture signal as in FIG. 9A in the fourth embodiment. FIG. 11B shows the gradation modification performed in the fifth embodiment. Since the rollover gradation CX is closer to the minimum gradation value Pmin than to the maximum gradation value Pmax (Pmax−CX>CX−Pmin), the gradation modifier 26' compresses the range of gradation values from the range from Pmin to Pmax to the smaller range from CX to Pmax, as shown in FIG. 11B. If the input gradation value is Pin, then the modified output gradation value Pout is calculated as follows:

$$Pout=(Pin-Pmin)\times(Pmax-CX)/(Pmax-Pmin)+CX$$

This modification leaves a more natural appearance than the modification in the fourth embodiment, because the gradation at the end of the non-edge area has the same value as before the modification, and the average size of the modification is smaller than in FIG. 9B.

Figure 12A:
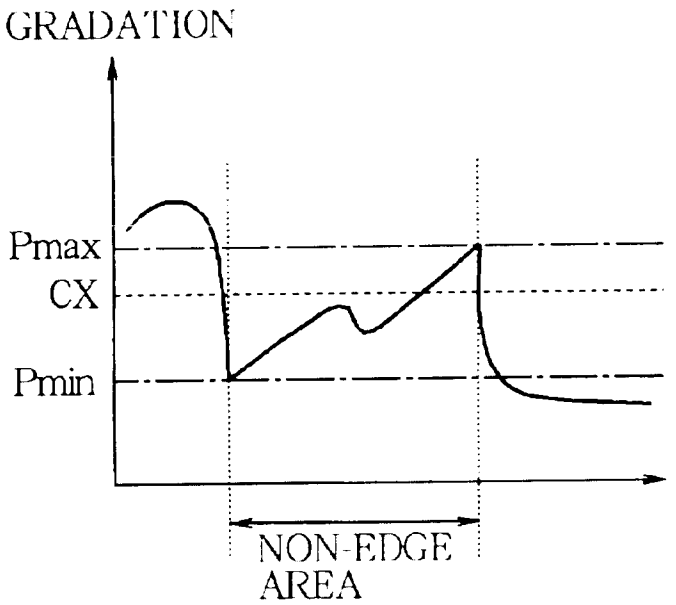
FIGS. 12A and 12B show another example of the operation of the gradation modifier in the fifth embodiment.
Figure 12B:
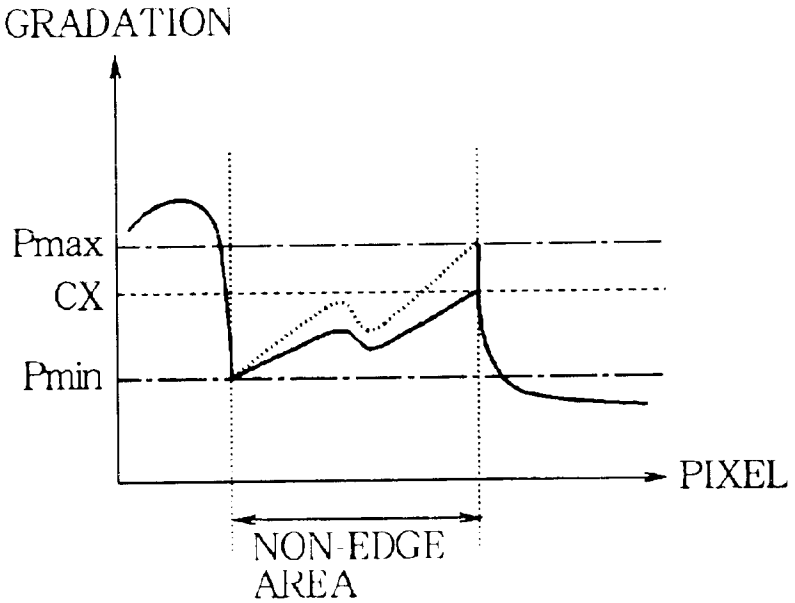

The graph in FIG. 12A shows the same digital signal as the graph in FIG. 10A in the fourth embodiment. FIG. 12B shows the gradation modification performed in the fifth embodiment. Since the rollover gradation CX is closer to the maximum gradation value Pmax than to the minimum gradation value Pmin (more precisely, since Pmax−CX≦CX−Pmin), the gradation modifier 26' compresses the range of gradation values from the range from Pmin to Pmax to the range from Pmin to CX, as shown in FIG. 12B. If the input gradation value is Pin, then the modified output gradation value Pout is calculated as follows:

$$Pout=(Pin-Pmin)\times(CX-Pmin)/(Pmax-Pmin)+Pmin.$$

This modification also leads to a more natural appearance than in the fourth embodiment, because the gradation at the beginning of the non-edge area has the same value as before the modification, and the average size of the modification is smaller than in FIG. 10B.

If the fifth embodiment is limited to the same maximum modification value as in the fourth embodiment, it can avoid rollover gradations to the same extent as in the fourth embodiment, but the average modification value is smaller than in the fourth embodiment, so the modified picture has a more natural appearance. Conversely, the fifth embodiment can be permitted to make larger modifications than in the fourth embodiment, thereby suppressing pseudo-contours more effectively, while maintaining the same degree of naturalness as in the fourth embodiment.

A few variations in the preceding embodiments have been mentioned above, but those skilled in the art will recognize that further variations are possible within the scope of the invention as defined by the appended claims.

What is claimed is:

1. A method of suppressing pseudo-contours in a display apparatus employing a subfield drive system to display a moving picture, comprising:

extracting at least one area with smoothly varying gradation values from a predetermined unit of the moving picture;

identifying a minimum gradation value and a maximum gradation value occurring in the area;

deciding whether any gradation transition between said minimum gradation value and said maximum gradation value causes a high-order rollover, said high-order rollover being defined as a change between a light-emitting state and a non-light-emitting state in any subfield having a light-emission duration longer than a predetermined duration; and processing the area so as to eliminate the high-order rollover.

2. The method of claim 1, wherein the predetermined unit of the moving picture is one field.

3. The method of claim 1, wherein the predetermined unit of the moving picture is one raster line.

4. The method of claim 1, wherein processing the area further comprises:

selecting a subfield sequence free of said high-order rollover between said minimum gradation value and said maximum gradation value; and using said subfield sequence to display the area.

5. The method of claim 1, wherein processing the area further comprises modifying the gradation values in the area.

6. The method of claim 1, wherein processing the area so as to eliminate the high-order rollover is based on the identified minimum and maximum gradation values occurring in the area.

7. A display apparatus for displaying a moving-picture signal made up of a series of fields, each field being divided into a plurality of subfields having different light-emission durations, at least two of the light-emission durations having a length ratio differing from a power of two, different gradations in the moving-picture signal being displayed by different patterns of subfields in which light is emitted, the display apparatus comprising:

a code conversion unit for converting the moving-picture signal to digital codes designating patterns of subfields taken from a plurality of mutually differing subfield sequences, each subfield sequence specifying patterns of subfields for all possible gradations of the moving-picture signal;

an area detector for detecting at least one area having smoothly varying gradation values in a predetermined unit of the moving-picture signal;

a gradation range calculator for detecting a maximum gradation value and a minimum gradation value in each said area;

a subfield sequence selection unit for selecting, from among the plurality of mutually differing subfield sequences, a subfield sequence free of high-order rollover between said maximum gradation value and said minimum gradation value, and causing the code conversion unit to take patterns of subfields from the selected subfield sequence, said high-order rollover being defined as a change between a light-emitting state and a non-light-emitting state in any subfield having a light-emission duration longer than a predetermined duration; and a signal delay unit for delaying the moving-picture signal input to the code conversion unit by a time equivalent to a total processing time of the area detector, the gradation range calculator, and the subfield sequence selection unit.

8. The display apparatus of claim 7, wherein said predetermined unit of the moving-picture signal is one field.

9. The display apparatus of claim 7, wherein said predetermined unit of the moving-picture signal is one raster line.

10. The display apparatus of claim 7, wherein said code conversion unit uses just two said subfield sequences.

11. The display apparatus of claim 10, wherein said high-order rollover occurs alternately in the two subfield sequences, in ascending order of gradation value.

12. The display apparatus of claim 7, wherein said code conversion unit uses at least three said subfield sequences.

13. The display apparatus of claim 7, wherein the code conversion unit further comprises:

a plurality of code converters, each employing a different one of said subfield sequences to convert the moving-picture signal; and a code conversion selector for selecting an output of one of the plurality of code converters.

14. The display apparatus of claim 7, wherein the area detector comprises:

an edge detector for detecting rapid variations in gradation value; and an area extractor for extracting areas free of said rapid variations.

15. The display apparatus of claim 7, wherein if said high-order rollover occurs between said maximum gradation value and said minimum gradation value in all of said subfield sequences, the subfield sequence selection unit selects the plurality of subfield sequences cyclically in said area.

16. A display apparatus for displaying a moving-picture signal made up of a series of fields, each field being divided into a plurality of subfields having different light-emission durations, at least two of the light-emission durations having a length ratio differing from a power of two, different gradations in the moving-picture signal being displayed by different patterns of subfields in which light is emitted, the display apparatus comprising:

an area detector for detecting at least one area having smoothly varying gradation values in a predetermined unit of the moving-picture signal;

a gradation range calculator for detecting a maximum gradation value and a minimum gradation value in each said area; and a gradation modification unit for modifying the gradation values in said area so as to eliminate a high-order rollover from said area, said high-order rollover being defined as a change between a light-emitting state and a non-light-emitting state in any subfield having a light-emission duration longer than a predetermined duration.

17. The display apparatus of claim 16, wherein said gradation modification unit comprises:

a signal delay unit for delaying the moving-picture signal by a total time equivalent to a processing time of the area detector and the gradation range calculator; and a gradation modifier for modifying the gradation values in said area in the delayed moving-picture signal.

18. The display apparatus of claim 17, wherein said gradation modifier modifies the gradation values in said area by adding a uniform adjustment value.

19. The display apparatus of claim 17, wherein said gradation modifier modifies the gradation values in said area by compressing a range of variation of the gradation values in said area.

20. The display apparatus of claim 16, wherein the area detector comprises:

an edge detector for detecting rapid variations in gradation value; and an area extractor for extracting areas free of said rapid variations.

21. The display apparatus of claim 16, wherein said gradation modification unit modifies the gradation values in said area based on the detected maximum gradation value and minimum gradation value in each said area.

* * * * *